US007082940B2

(12) United States Patent
Takeuchi et al.

(10) Patent No.: US 7,082,940 B2
(45) Date of Patent: Aug. 1, 2006

(54) WIRE SAWING APPARATUS AND WIRE SAWING METHOD

(75) Inventors: Yukihisa Takeuchi, Aichi-pref. (JP); Hiroyuki Tsuji, Nagoya (JP); Kazumasa Kitamura, Itinomiya (JP); Masashi Watanabe, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/985,743

(22) Filed: Nov. 10, 2004

(65) Prior Publication Data

US 2005/0183713 A1 Aug. 25, 2005

Related U.S. Application Data

(60) Provisional application No. 60/519,815, filed on Nov. 13, 2003.

(51) Int. Cl.
*B28D 1/08* (2006.01)

(52) U.S. Cl. ..... 125/21; 125/16.02

(58) Field of Classification Search ..... 125/21, 125/16.01, 19

See application file for complete search history.

(56) References Cited

U.S. PATENT DOCUMENTS

| | | | | |
|---|---|---|---|---|
| 5,628,301 | A * | 5/1997 | Katamachi | 125/21 |
| 5,715,807 | A * | 2/1998 | Toyama et al. | 125/16.02 |
| 5,907,988 | A * | 6/1999 | Kiuchi et al. | 83/651.1 |
| 6,109,253 | A * | 8/2000 | Ikehara | 125/12 |
| 6,408,839 | B1 * | 6/2002 | Hauser | 125/16.02 |
| 6,568,384 | B1 * | 5/2003 | Onizaki | 125/16.02 |

* cited by examiner

*Primary Examiner*—Dung Van Nguyen
(74) *Attorney, Agent, or Firm*—Burr & Brown

(57) ABSTRACT

A wire sawing apparatus includes a wire, a wire feed roller, and two basic rollers. The three rollers have the same diameter and are arranged in such a manner that their axes of rotation are in parallel with one another. Cutting-positioning circumferential grooves are formed on the two basic rollers at axially paired same positions. Intermediate circumferential grooves are formed on the wire feed roller and arranged in the axial direction such that the axial position of each intermediate circumferential groove corresponds to an axially central position between two adjacent pairs of cutting-positioning circumferential grooves. The wire is spirally wound a plurality of turns on the three rollers while being fitted into the circumferential grooves.

8 Claims, 22 Drawing Sheets

FIG.35
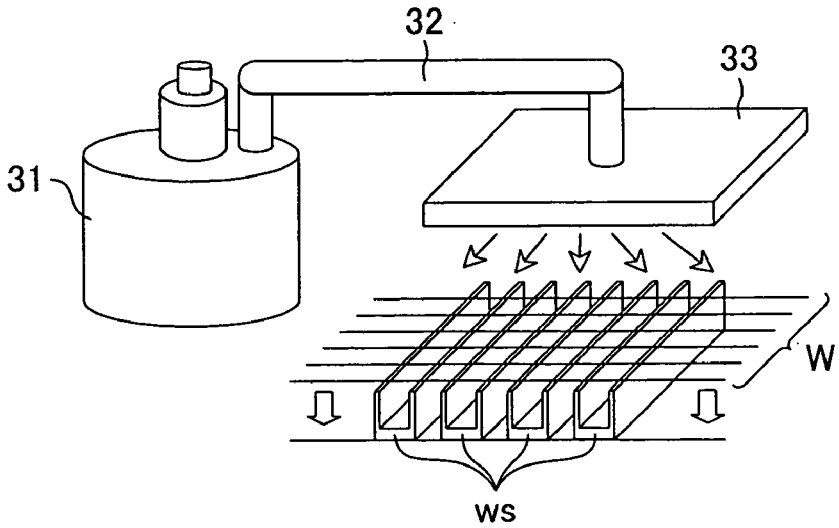
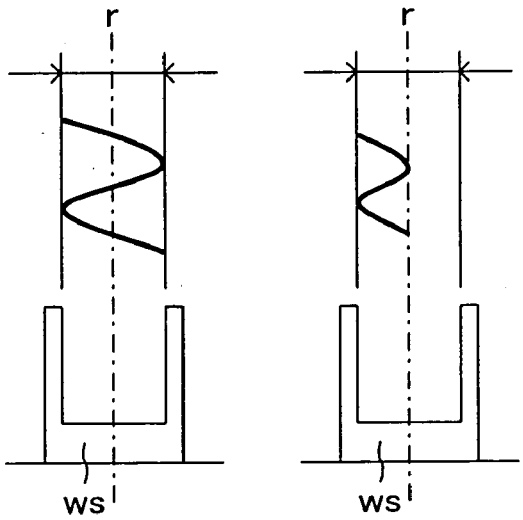
FIG.36A FIG.36B
FIG.37
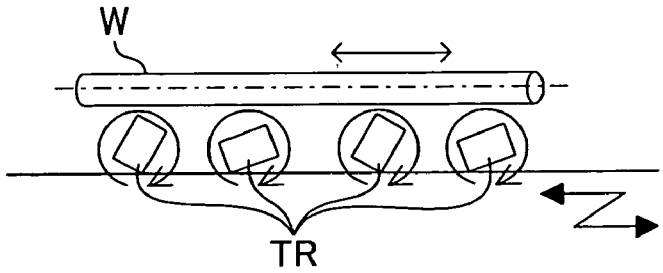

WIRE SAWING APPARATUS AND WIRE SAWING METHOD

CROSS REFERENCE TO RELATED APPLICATION

This application claims the benefit under 35 U.S.C. § 119(e) of U.S. Provisional Application Ser. No. 60/519,815, filed Nov. 13, 2003, the entirety of which is incorporated herein by reference.

BACKGROUND OF THE INVENTION

1. Field of the Invention

The present invention relates to a wire sawing apparatus whose linear wire is caused to reciprocate in its own linear direction and to cut into an object to be cut to thereby cut the object, as well as to a wire sawing method using the wire saw.

2. Description of the Related Art

In recent years, a piezoelectric/electrostrictive device has been developed as an actuator for precision working; as an actuator for controlling the position of a read and/or write element (head) for reading and/or writing optical information, magnetic information, or like information; as a sensor for converting mechanical vibration to an electrical signal; or as a like device. The piezoelectric/electrostrictive device includes a stationary portion, a thin-plate portion supported by the stationary portion, and a piezoelectric/electrostrictive element including laminar electrodes and piezoelectric/electrostrictive layers.

FIG. 38 shows an example of such a piezoelectric/electrostrictive device, which is disclosed in Japanese Patent Application Laid-Open (kokai) No. 2001-320103. The piezoelectric/electrostrictive device includes a stationary portion 100; thin-plate portions 110 supported by the stationary portion 100; holding portions (movable portions) 120 provided at corresponding tip ends of the thin-plate portions 110 and adapted to hold an object; and piezoelectric/electrostrictive elements 130 formed at least on corresponding planes of the thin-plate portions 110, each piezoelectric/electrostrictive element 130 including a plurality of electrodes and a plurality of piezoelectric/electrostrictive layers arranged alternatingly in layers. An electric field is generated between electrodes of the piezoelectric/electrostrictive elements 130 so that the piezoelectric/electrostrictive layers of the piezoelectric/electrostrictive elements 130 extend and contract, whereby the thin-plate portions 110 are deformed. The deformation of the thin-plate portions 110 causes displacement of the holding portions 120 (accordingly, displacement of the object held by the holding portions 120).

The piezoelectric/electrostrictive device of FIG. 38 is manufactured as follows. First, as shown in FIG. 39, a plurality of ceramic green sheets (and/or a ceramic green sheet laminate) are prepared. As shown in FIG. 40, these ceramic green sheets are laminated and then fired, thereby forming a ceramic laminate 200. As shown in FIG. 41, piezoelectric/electrostrictive laminates 210 each including a plurality of electrodes and a plurality of piezoelectric/electrostrictive layers arranged alternatingly in layers are formed on the surface of the ceramic laminate 200. A monolithic body consisting of the ceramic laminate 200 and the piezoelectric/electrostrictive laminates 210 (the monolithic body being an object to be cut) is cut along cutting lines C1 to C4 shown in FIG. 42, thereby yielding the piezoelectric/electrostrictive device.

Such cutting can be performed by mechanical machining, such as wire sawing or dicing, as well as laser machining, such as YAG laser machining, excimer laser machining, or electron beam machining. Cutting the ceramic laminate 200 and the piezoelectric/electrostrictive laminates 210 along the cutting lines C3 and C4 includes cutting of the components of the piezoelectric/electrostrictive laminates 210; i.e., cutting of piezoelectric/electrostrictive layers which are relatively low in strength and fragile, and a metal which is ductile. Thus, machining (e.g., dicing) that imposes a large machining load on an object to be cut is undesirable. Machining of another type (e.g., wire sawing) that imposes a small machining load on an object to be cut is desirable.

In the above-described piezoelectric/electrostrictive device, the relationship between the displacement of an object held between the holding portion 120 and the intensity of electric field generated between the electrodes (i.e., an operating characteristic of the piezoelectric/electrostrictive device) must be of very high accuracy. The relationship between the displacement of the object and the electric field intensity depends greatly on the shape (geometric accuracy) of the piezoelectric/electrostrictive device (particularly, the thin-plate portions 110). Accordingly, when wire sawing is applied to cutting along the cutting lines C3 and C4, wire sawing must be performed at very high accuracy.

SUMMARY OF THE INVENTION

In view of the foregoing, the inventers of the present invention have discovered a wire sawing apparatus capable of performing wire sawing at high accuracy, as well as a wire sawing method using the wire saw through a variety of ingenuities.

A wire sawing apparatus according to the present invention comprises two basic rollers disposed with their axes of rotation in parallel with each other, a plurality of cutting-positioning circumferential grooves being provided on the cylindrical surface of each of the two basic rollers and arranged in the axial direction, the cutting-positioning circumferential grooves of one basic roller and the corresponding cutting-positioning circumferential grooves of the other basic roller being paired and located at the same axial positions; a wire feed roller disposed with its axis of rotation not located on a plane including the axes of rotation of the two basic rollers and with its axis of rotation in parallel with the axes of rotation of the two basic rollers, a plurality of intermediate circumferential grooves being provided on the cylindrical surface of the wire feed roller and arranged in the axial direction, the axial positions of intermediate circumferential grooves each corresponding to a substantially axially central position between two adjacent pairs of cutting-positioning circumferential grooves; and a wire spirally wound a plurality of turns around the two basic rollers and the wire feed roller from a first end to a second end with respect to the axial direction by repeating a unit winding operation of winding the wire in such a manner that the wire is fitted into one pair of two adjacent pairs of cutting-positioning circumferential grooves, the one pair being located on a side toward the first end, is fitted into an intermediate circumferential groove corresponding to the adjacent pairs of cutting-positioning circumferential grooves, and is then fitted into the other pair of cutting-positioning circumferential grooves located on a side toward the second end. In the wire sawing apparatus, a plurality of linear portions of the wire extending between the two basic rollers and arranged at axial positions corresponding to the pairs of cutting-positioning circumferential grooves are caused to reciprocate in their own linear directions along with a rotary movement of the three rollers and to cut into a object to be cut, thereby cutting the object simultaneously at a plurality of positions.

Generally, in a wire sawing apparatus which includes two basic rollers, a single wire feed roller, and a wire wound on the two basic rollers and on the single wire feed roller and in which the axes of rotation of the three rollers are in parallel with each other, a plurality of cutting-positioning circumferential grooves are provided on the surface of each of the two basic rollers and arranged in the axial direction such that the cutting-positioning circumferential grooves of one basic roller and the corresponding cutting-positioning circumferential grooves of the other basic roller are paired and located at the same axial positions, whereas a plurality of wire-feeding circumferential grooves are provided on the surface of the wire feed roller at the same axial positions as those of a plurality of pairs of cutting-positioning circumferential grooves.

In the above wire sawing apparatus, for example, the wire is wound a plurality of turns on the three rollers along the axial direction by unidirectionally repeating the step of winding the wire on the two basic rollers in such a manner that the wire is fitted into a pair of cutting-positioning circumferential grooves, then winding the wire on the wire feed roller in such a manner that the wire is fitted into a wire-feeding circumferential groove located at the same axial position as that of the next pair of cutting-positioning circumferential grooves, and subsequently winding the wire on the two basic rollers in such a manner that the wire is fitted into the next pair of cutting-positioning circumferential grooves.

In the thus-configured wire sawing apparatus, linear portions of the wire extending between the wire feed roller and one of the two basic rollers are such that opposite end portions of each of the linear portions are located at the same axial position. Accordingly, the linear portions of the wire extend perpendicular to the axial direction. Thus, the tension of the wire does not induce an axial force that acts on the basic roller at the cutting-positioning circumferential grooves.

Meanwhile, linear portions of the wire extending between the wire feed roller and the other basic roller are such that opposite end portions of each of the linear portions are located at different axial positions, the distance between the axial positions being equal to the interval between two adjacent cutting-positioning circumferential grooves. Accordingly, the linear portions of the wire extend in an inclined direction that forms a predetermined angle corresponding to the interval with respect to a direction perpendicular to the axial direction. Thus, the tension of the wire induces an axial force that is associated with the interval and acts on the other basic roller at the cutting-positioning circumferential grooves.

Such an axial force induced by the wire tension accelerates, for example, friction between the wire and the cutting-positioning circumferential grooves (side walls of the cutting-positioning circumferential grooves) of the other basic roller, potentially causing an impairment in the accuracy of the axial position of linear portions of the wire extending between the two basic rollers (accordingly, an impairment in accuracy in machining an object to be cut). In such a wire sawing apparatus, an increase in the axial interval between the cutting-positioning circumferential grooves increases an axial force that the wire tension induces in association with the interval and that acts on the other basic roller at the cutting-positioning circumferential grooves. As a result, as the cumulative time of operation of the wire sawing apparatus increases, accuracy in machining an object to be cut potentially drops to a great extent.

By contrast, in the wire sawing apparatus according to the present invention, the wire is wound a plurality of turns on the two basic rollers and on the wire feed roller along the axial direction by unidirectionally repeating a unit winding operation. The unit winding operation involves two adjacent pairs of cutting-positioning circumferential grooves, and one intermediate circumferential groove whose axial position corresponds to a substantially axially central position between the two adjacent pairs of cutting-positioning circumferential grooves. The unit winding operation comprises the steps of winding the wire on the two basic rollers in such a manner that the wire is fitted into one of the two pairs of cutting-positioning circumferential grooves, winding the wire on the wire feed roller in such a manner that the wire is fitted into the intermediate circumferential groove, and winding the wire on the two basic rollers in such a manner that the wire is fitted into the other pair of cutting-positioning circumferential grooves. Accordingly, the tension of the wire induces an axial force that is associated with substantially half the interval between two adjacent cutting-positioning circumferential grooves and acts on the two basic rollers at the cutting-positioning circumferential grooves. The axial force is smaller than an axial force that the wire tension induces in association with the interval between two adjacent cutting-positioning circumferential grooves. Thus, there can be realized a reduction in the degree of impairment in accuracy in machining an object to be cut, the accuracy being impaired with the cumulative time of operation of the wire saw. Therefore, wire sawing can be performed at high accuracy.

A wire sawing method for cutting an object to be cut by use of the wire sawing apparatus according to the present invention comprises the steps of disposing the object to be cut on a stage; reciprocating a plurality of linear portions of a wire in their own linear directions; and varying a relative position between the stage and the linear portions of the wire with respect to a cutting advancement direction so as to cause the plurality of linear portions of the wire to cut into the object to be cut, thereby cutting the object.

Another wire sawing method according to the present invention comprises the steps of disposing an object to be cut on a stage; reciprocating a linear wire in its own linear direction while feeding slurry containing abrasive grains to the object to be cut; and varying a relative position between the stage and the wire with respect to a cutting advancement direction so as to cause the wire to cut into the object to be cut, thereby cutting the object. In the wire sawing method, at least a pair of guides, each having a guide portion for guiding the wire to a cutting position, are disposed on the stage in such a manner that the object to be cut is located therebetween, and the wire guided by the guide portions cuts into the guides and then the object to be cut, thereby cutting the guides and the object together; and the paired guides assume such a shape that the length of their portion to be cut as measured in the linear direction of the wire varies in a predetermined pattern with the depth of penetration of the wire into the guides.

According to the wire sawing method of the present invention, before start of cutting of an object to be cut disposed on the stage, the linear wire reciprocating in its own linear direction is accurately guided to a cutting position of the object by the guide portions (e.g., grooves) of the paired guides, which are disposed on the stage in such a manner that the object is located therebetween. Next, the wire, which is accurately positioned at the cutting position, cuts into the guide portions of the guides before cutting into the object. As a result, the reciprocating motion of the wire is stabilized, so that the wire reciprocates accurately at the cutting position of the object without involvement of any deviation from the cutting position (without involvement of vibration perpendicular to the linear direction of the wire). In this condition, cutting the object starts. Accordingly, wire sawing can be performed at high accuracy.

The paired guides assume such a shape that the length of their portion to be cut as measured in the linear direction of the wire varies in a predetermined pattern with the depth of penetration of the wire into the guides. This feature concomitantly produces an action described below.

As mentioned previously, wire sawing is performed while slurry containing abrasive grains is fed to the object to be cut (more specifically, to a clearance between a wire and the cut surface of the object). In this case, when the feed rate of the wire (in a cutting advancement direction) is set relatively high, a delay in feed of slurry into the clearance increases with the depth of penetration of the wire into the object, potentially failing to maintain smooth cutting. In order to avoid this problem, conventionally, for example, servo control has been applied to the feed rate of the wire so as to periodically lower the feed rate of the wire (or periodically render the wire feed rate zero), by use of a complicated, large-sized hydraulic servomechanism.

By contrast, the wire sawing method of the present invention employs a pair of guides, which assume the above-mentioned shape and undergo cutting along with an object to be cut. Accordingly, an area to be machined by a wire varies in a predetermined pattern with the depth of penetration of the wire into the object (accordingly, with the depth of penetration of the wire into the guides). As a result, the machining load of the wire also varies in a predetermined pattern. Therefore, for example, merely by setting an appropriate, constant feed load of the wire (a load that the wire imposes on the object), the feed rate of the wire can be varied in the above-mentioned predetermined pattern without use of the above-mentioned hydraulic servomechanism or the like. The wire can impose an appropriate, constant feed load on the object, for example, as follows: a weight having a predetermined mass, pulleys, etc. are arranged in such a manner that gravitational force (or part of gravitational force) acting on the weight is used as a load that the wire imposes on the object.

Thus, for example, wire feed rate control can be performed in such a manner as to periodically lower the feed rate of the wire in accordance with a predetermined pattern. As a result, an increase in a delay in feed of slurry can be reliably prevented by means of a simple configuration.

A further wire sawing method according to the present invention comprises the steps of disposing an object to be cut on a stage; reciprocating a linear wire in its own linear direction while feeding slurry containing abrasive grains to the object to be cut; and varying a relative position between the stage and the wire with respect to a cutting advancement direction so as to cause the wire to cut into the object to be cut, thereby cutting the object. In the wire sawing method, guide portions for guiding the wire to a cutting position at the time of start of cutting are provided on the object to be cut in the vicinity of opposite end portions of a cutting zone with respect to the linear direction of the wire, and a slurry pocket for trapping the fed slurry is provided on the object to be cut so as to allow the trapped slurry to be fed into a clearance between the wire and a cut surface of the object to be cut.

According to the wire sawing method of the present invention, guide portions (e.g., grooves) for guiding the wire to a cutting position at the time of start of cutting are provided beforehand on an object to be cut in the vicinity of opposite end portions of a cutting zone with respect to the linear direction of the wire (the reciprocating direction of the wire). When the reciprocating linear wire comes into contact with and starts cutting the object, the wire is slightly bent in the cutting advancement direction in the vicinity of opposite end portions of the cutting zone while being guided by the guide portions (e.g., being fitted into grooves) of the object. As a result, as in the above-described case, the wire is accurately guided to a cutting position of the object and performs cutting of the object. Accordingly, wire sawing can be performed at high accuracy.

Also, a slurry pocket for trapping the fed slurry is provided beforehand on an object to be cut so as to allow the trapped slurry to be fed into a clearance between the wire and a cut surface of the object. Accordingly, a sufficient amount of slurry can be continuously fed into the clearance, thereby reliably preventing an increase in a delay in feed of slurry.

Preferably, the object to be cut by use of the wire sawing apparatus or wire sawing method according to the present invention include a plurality of integrally formed piezoelectric/electrostrictive devices which are separated from one another as a result of wire sawing and each of which comprises a thin-plate portion; a stationary portion supporting the thin-plate portion; and a piezoelectric/electrostrictive element formed at least on a plane of the thin-plate portion, the piezoelectric/electrostrictive element including a plurality of electrodes and a plurality of piezoelectric/electrostrictive layers arranged alternatingly in layers, and having an exteriorly exposed lateral end surface including lateral end surfaces of the plurality of electrodes and lateral end surfaces of the plurality of piezoelectric/electrostrictive layers, and at least the exteriorly exposed lateral end surface of the piezoelectric/electrostrictive element being formed by wire sawing.

As mentioned previously, in order to enhance the accuracy of operating characteristics of a piezoelectric/electrostrictive device, the shape of the piezoelectric/electrostrictive device (particularly, the shape of its thin-plate portion, a piezoelectric/electrostrictive element being formed on a plane of the thin-plate portion) must be machined at high accuracy. Accordingly, when an object which includes a plurality of integrally formed piezoelectric/electrostrictive devices is cut by use of the apparatus or method of the present invention, it is possible to manufacture piezoelectric/electrostrictive devices capable of exhibiting highly accurate operating characteristics.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which:

FIG. 35 is a perspective view showing a general slurry feeder;

FIGS. 36A and 36B are views showing the relationship between the width of an opening portion of a workpiece and an appropriate amplitude of vibration in a case where vibration is ultrasonically imparted to the machining stage on which the workpieces are arranged;

FIG. 37 is a view showing rotation of abrasive grains contained in slurry in a case where the direction of ultrasonically induced vibration of the machining stage is caused to coincide with the direction of a reciprocating motion of the wire;

DESCRIPTION OF THE PREFERRED EMBODIMENTS

Embodiments of a wire sawing apparatus and wire sawing method according to the present invention will next be described in detail with reference to the drawings. Before starting the description, an example piezoelectric/electrostrictive device will be described.

Figure 1:
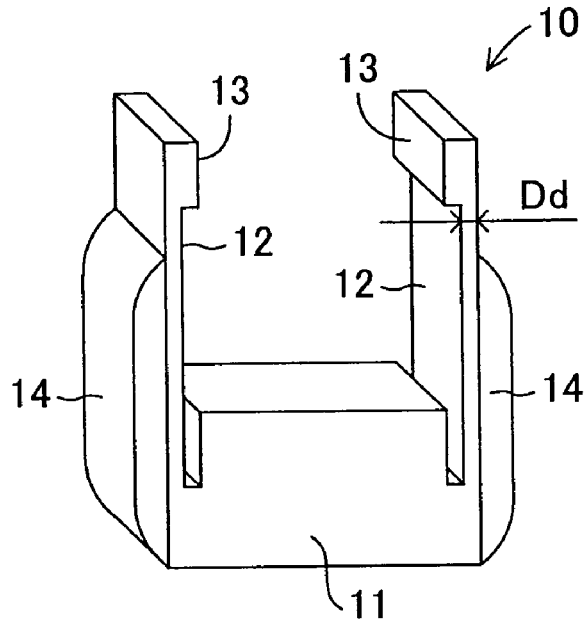
FIG. 1 is a perspective view of a general piezoelectric/electrostrictive device.

As shown in the perspective view of FIG. 1, a piezoelectric/electrostrictive device 10 includes a stationary portion 11 in the shape of a rectangular parallelepiped; a pair of mutually facing thin-plate portions 12, which are supported by the stationary portion 11 in a standing condition; two holding portions (movable portions) 13 provided at corresponding tip ends of the thin-plate portions 12 and having a thickness greater than that of the thin-plate portions 12; and two piezoelectric/electrostrictive elements 14 formed at least on corresponding outer planes of the thin-plate portions 12 and including laminar electrodes and piezoelectric/electrostrictive layers arranged alternatingly in layers. The general configurations of these portions are disclosed in, for example, Japanese Patent Application Laid-Open (kokai) No. 2001-320103.

Figure 2:
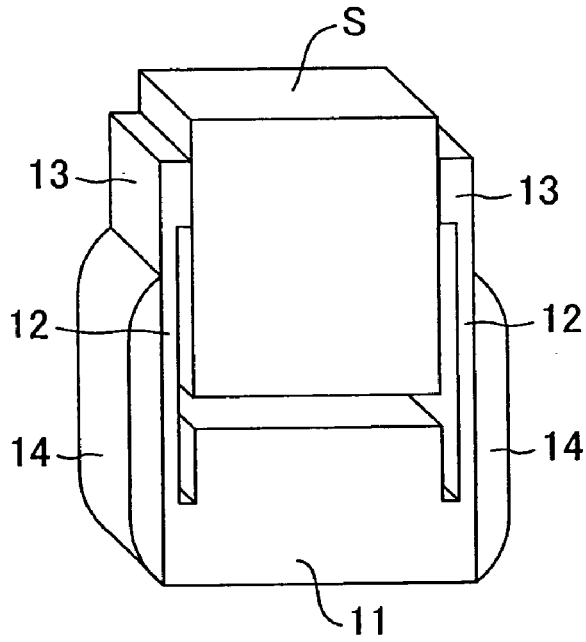
FIG. 2 is a perspective view showing the piezoelectric/electrostrictive device of FIG. 1 and an object held by the piezoelectric/electrostrictive device.

As shown in FIG. 2, the piezoelectric/electrostrictive device 10 is used, for example, as an actuator in which an object S is held between the paired holding portions 13, and force generated by the piezoelectric/electrostrictive elements 14 causes the thin-plate portions 12 to be deformed to thereby displace the holding portions 13 for controlling the position of the object S. The object S is a magnetic head, an optical head, a sensitivity-adjusting weight for use in a sensor, or the like.

A portion (also generically called a "substrate portion") that the stationary portion 11, the thin-plate portions 12, and the holding portions 13 constitute is a ceramic laminate, which is formed by firing a laminate of ceramic green sheets as will be described later in detail. Such a monolithic ceramic element does not use an adhesive for joining its portions and is thus almost free from a change in state with time, thereby providing a highly reliable joint and having advantage in terms of attainment of rigidity. The ceramic laminate can be readily manufactured by a ceramic green sheet lamination process, which will be described later.

The entire substrate portion may be formed from ceramic or metal or may assume a hybrid structure in which ceramic and metal are used in combination. Also, the substrate portion may be configured such that ceramic pieces are bonded together by means of an adhesive, such as an organic resin or glass, or such that metallic pieces are joined together by means of brazing, soldering, eutectic bonding, diffusion joining, welding, or the like.

Figure 3:
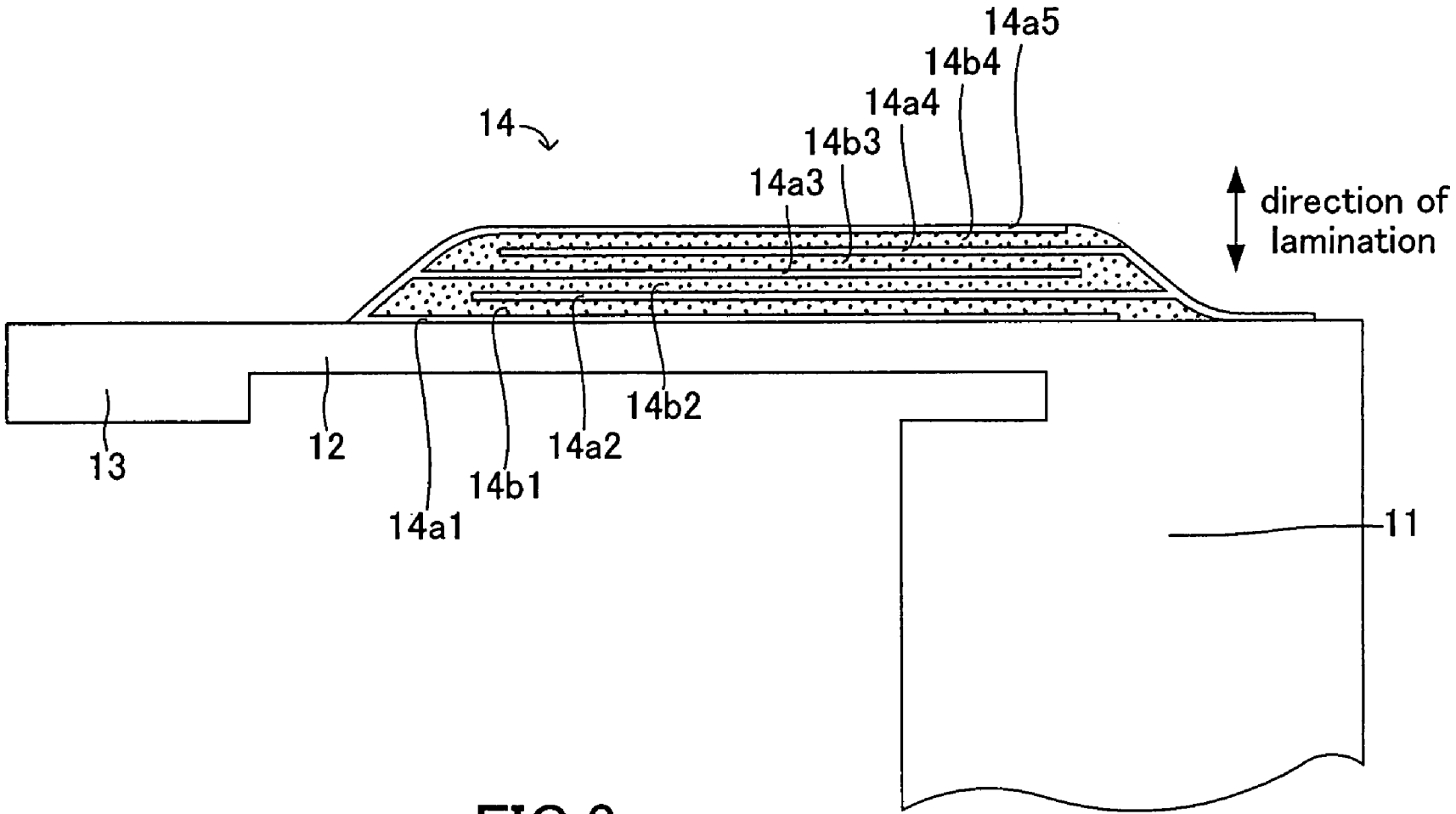
FIG. 3 is an enlarged fragmental front view of the piezoelectric/electrostrictive device of FIG. 1.

As shown in the enlarged view of FIG. 3, the piezoelectric/electrostrictive element 14 is formed on an outer wall surface (outer plane) formed by the stationary portion 11 (a portion of the stationary portion) and the thin-plate portion 12 (a portion of the thin-plate portion), includes a plurality of laminar electrodes and a plurality of piezoelectric/electrostrictive layers, and assumes the form of a laminate in which the laminar electrodes and the piezoelectric/electrostrictive layers are arranged alternatingly in layers. The electrode layers and the piezoelectric/electrostrictive layers are parallel to the plane of the thin-plate portion 12. More specifically, the piezoelectric/electrostrictive element 14 is a laminate in which an electrode 14*a*1, a piezoelectric/electrostrictive layer 14*b*1, an electrode 14*a*2, a piezoelectric/electrostrictive layer 14*b*2, an electrode 14*a*3, a piezoelectric/electrostrictive layer 14*b*3, an electrode 14*a*4, a piezoelectric/electrostrictive layer 14*b*4, and an electrode 14*a*5 are laminated in that order on the outer plane of the thin-plate portion 12. The electrodes 14*a*1, 14*a*3, and 14*a*5 are electrically connected together and are insulated from the electrically connected electrodes 14*a*2 and 14*a*4. In other words, the electrically connected electrodes 14*a*1, 14*a*3, and 14*a*5 and the electrically connected electrodes 14*a*2 and 14*a*4 are arranged in a shape resembling the teeth of a comb.

The piezoelectric/electrostrictive element 14 is formed integrally with the substrate portion by a film formation process, which will be described later. Alternatively, the piezoelectric/electrostrictive element 14 may be manufactured separately from the substrate portion, followed by a process of joining the piezoelectric/electrostrictive element 14 to the substrate portion by use of an adhesive, such as an organic resin, or by means of glass, brazing, soldering, eutectic bonding, or the like.

The present embodiment shows a multilayered structure including five electrode layers; however, the number of layers is not particularly limited. Generally, as the number of layers increases, a force (drive force) for deforming the thin-plate portions 12 increase, but power consumption also increases. Accordingly, the number of layers may be selected according to, for example, application and the state of use.

A supplementary description of component elements of the piezoelectric/electrostrictive device 10 will next be given below.

The holding portions 13 operate on the basis of displacement of the thin-plate portions 12. Various members are attached to the holding portions 13 according to applications of the piezoelectric/electrostrictive device 10. For example, when the piezoelectric/electrostrictive device 10 is used as an element (displacing element) for displacing an object, particularly when the piezoelectric/electrostrictive 10 is used for positioning or suppressing wringing of a magnetic head of a hard disk drive, a slider having a magnetic head, a magnetic head, a suspension having a slider, or a like member (i.e., a member required to be positioned) may be attached. Also, the shield of an optical shutter or the like may be attached.

As mentioned previously, the stationary portion 11 is adapted to support the thin-plate portions 12 and the holding portions 13. When the piezoelectric/electrostrictive device 10 is used for, for example, positioning the magnetic head of a hard disk drive, the stationary portion 11 is fixedly attached to a carriage arm attached to a VCM (voice coil motor), to a fixture plate attached to the carriage arm, to a suspension, or to a like member. In some cases, unillustrated terminals and other members for driving the piezoelectric/electrostrictive elements 14 may be arranged on the stationary portion 11. The terminals may have a width similar to that of the electrodes or may be narrower or partially narrower than the electrodes.

No particular limitations are imposed on a material for the holding portions 13 and the stationary portion 11, so long as the holding portions 13 and the stationary portion 11 can have rigidity. Generally, use of a ceramic as the material is preferred, since a ceramic green sheet lamination process, which will be described later, can be applied. More specifically, examples of the material include a material that contains, as a main component, zirconia (such as stabilized zirconia or partially stabilized zirconia), alumina, silicon nitride, aluminum nitride, or titanium oxide; and a material that contains a mixture of them as a main component. A material that contains zirconia, particularly stabilized zirconia or partially stabilized zirconia, as a main component is preferred for the piezoelectric/electrostrictive device 10, since mechanical strength and toughness are high. When a metallic material is to be used for manufacturing the holding portions 13 and the stationary portion 11, stainless steel, nickel, or the like is preferred as the metallic material.

As mentioned previously, the thin-plate portions 12 are driven by the piezoelectric/electrostrictive elements 14. The thin-plate portions 12 are thin-plate-like members having flexibility and have a function for converting extension/contraction displacement of the piezoelectric/electrostrictive elements 14 disposed on their surfaces to bending displacement and transmitting the bending displacement to the corresponding holding portions 13. Accordingly, no particular limitations are imposed on the shape of and a material for the thin-plate portions 12, so long as the thin-plate portions 12 are flexible and have such mechanical strength as not to be broken from bending deformation; and the shape and material are selected in view of, for example, response and operability of the holding portions 13.

The thickness Dd (see FIG. 1) of the thin-plate portion 12 is preferably about 2 μm to 100 μm; and the total thickness of the thin-plate portion 12 and the piezoelectric/electrostrictive element 14 is preferably 7 μm to 500 μm. The thickness of each of the electrodes 14*a*1 to 14*a*5 is preferably 0.1 μm to 50 μm; and the thickness of each of the piezoelectric/electrostrictive layers 14*b*1 to 15*b*5 is preferably 3 μm to 300 μm.

Preferably, as in the case of the holding portions 13 and the stationary portion 11, a ceramic is used to form the thin-plate portions 12. Among ceramics, zirconia, particularly a material that contains stabilized zirconia as a main component, or a material that contains partially stabilized zirconia as a main component, is more preferred because of high mechanical strength exhibited even in thin-walled application, high toughness, and low reactivity with the electrode material of the electrodes 14*a*1 and the piezoelectric/electrostrictive layers 14*b*1, which constitute the piezoelectric/electrostrictive element 14.

The thin-plate portions 12 can also be formed from a metallic material that has flexibility and allows bending deformation. Among preferred metallic materials for the thin-plate portions 12, examples of ferrous materials include stainless steels and spring steels, and examples of nonferrous materials include beryllium copper, phosphor bronze, nickel, and nickel iron alloys.

Preferably, stabilized zirconia or partially stabilized zirconia to be used in the piezoelectric/electrostrictive device 10 is stabilized or partially stabilized in the following manner. At least one or more than one compound selected from the group consisting of yttrium oxide, ytterbium oxide, cerium oxide, calcium oxide, and magnesium oxide is added to zirconia to thereby stabilize or partially stabilize the zirconia.

Each of the compounds is added in the following amount: in the case of yttrium oxide or ytterbium oxide, 1 mol % to 30 mol %, preferably 1.5 mol % to 10 mol %; in the case of cerium oxide, 6 mol % to 50 mol %, preferably 8 mol % to 20 mol %; and in the case of calcium oxide or magnesium oxide, 5 mol % to 40 mol %, preferably 5 mol % to 20 mol %. Particularly, use of yttrium oxide as a stabilizer is preferred. In this case, preferably, yttrium oxide is added in an amount of 1.5 mol % to 10 mol % (more preferably, 2 mol % to 4 mol % when mechanical strength is regarded as important, or 5 mol % to 7 mol % when endurance reliability is regarded as important).

Alumina, silica, transition metal oxide, or the like can be added to zirconia as a sintering aid or the like in an amount of 0.05 wt % to 20 wt %. In the case where the piezoelectric/electrostrictive elements 14 are formed by means of film formation and monolithic firing, addition of alumina, magnesia, transition metal oxide, or the like is preferred.

In the case where at least one of the stationary portion 11, the thin-plate portion 12, and the holding portion 13 is formed from a ceramic, in order to obtain a ceramic having a high mechanical strength and stable crystal phase, the average crystal grain size of zirconia is preferably set to 0.05 μm to 3 μm, more preferably 0.05 μm to 1 μm. As mentioned previously, the thin-plate portions 12 may be formed from a ceramic similar to (but different from) that used to form the holding portions 13 and the stationary portion 11. However, preferably, the thin-plate portions 12 are formed from a material substantially identical with that of the holding portions 13 and the stationary portion 11 in view of enhancement of the reliability of joint portions, enhancement of the strength of the piezoelectric/electrostrictive device 10, and simplification of a procedure for manufacturing the piezoelectric/electrostrictive device 10.

A piezoelectric/electrostrictive device can use a piezoelectric/electrostrictive element of a unimorph type, a bimorph type, or the like. However, the unimorph type, in which the thin-plate portions 12 and corresponding piezoelectric/electrostrictive elements are combined together, is advantageous in terms of stability of displacement quantity, a reduction in weight, and easy design for avoiding occurrence of opposite orientations between stress generated in the piezoelectric/electrostrictive element and strain associated with deformation of the piezoelectric/electrostrictive device. Therefore, the unimorph type is suited for the piezoelectric/electrostrictive device 10.

When, as shown in FIG. 1, the piezoelectric/electrostrictive elements 14 are formed in such a manner that one end of each of the piezoelectric/electrostrictive elements 14 is located on the stationary portion 11 (or the corresponding holding portion 13), whereas the other end is located on the plane of the corresponding thin-plate portion 12, the thin-plate portions 12 can be driven to a greater extent.

Preferably, the piezoelectric/electrostrictive layers 14*b*1 to 14*b*4 are formed from a piezoelectric ceramic. Alternatively, the piezoelectric/electrostrictive layers 14*b*1 to 14*b*4 may be formed from an electrostrictive ceramic, a ferroelectric ceramic, or an antiferroelectric ceramic. In the case where, in the piezoelectric/electrostrictive device 10, the linearity between the displacement quantity of the holding portions 13 and a drive voltage (or output voltage) is regarded as important, preferably, the piezoelectric/electrostrictive layers 14*b*1 to 14*b*4 are formed from a material having low strain hysteresis. Therefore, preferably, the piezoelectric/electrostrictive layers 14*b*1 to 14*b*4 are formed from a material whose coercive electric field is 10 kV/mm or less.

A specific material for the piezoelectric/electrostrictive layers 14*b*1 to 14*b*4 is a ceramic that contains, singly or in combination, lead zirconate, lead titanate, magnesium lead niobate, nickel lead niobate, zinc lead niobate, manganese lead niobate, antimony lead stannate, manganese lead tungstate, cobalt lead niobate, barium titanate, sodium bismuth titanate, potassium sodium niobate, strontium bismuth tantalate, and the like.

Particularly, a material that contains a predominant amount of lead zirconate, lead titanate, and magnesium lead niobate, or a material that contains a predominant amount of sodium bismuth titanate is preferred as a material for the piezoelectric/electrostrictive layers 14*b*1 to 14*b*4, in view of high electromechanical coupling coefficient, high piezoelectric constant, low reactivity with the thin-plate (ceramic) portion 12 during sintering of the piezoelectric/electrostrictive layers 14*b*1 to 14*b*4, and obtainment of consistent composition.

Furthermore, there can be used, as a material for the piezoelectric/electrostrictive layers 14*b*1 to 14*b*4, a ceramic that contains an oxide of, for example, lanthanum, calcium, strontium, molybdenum, tungsten, barium, niobium, zinc, nickel, manganese, cerium, cadmium, chromium, cobalt, antimony, iron, yttrium, tantalum, lithium, bismuth, or tin. In this case, incorporation of lanthanum or strontium into lead zirconate, lead titanate, or magnesium lead niobate, which is a predominant component, may yield in some cases such an advantage that coercive electric field and a piezoelectric characteristic become adjustable.

Notably, addition of a material prone to vitrify, such as silica, to a material for the piezoelectric/electrostrictive layers 14*b*1 to 14*b*4 is desirably avoided. This is because silica or a like material is prone to react with a piezoelectric/electrostrictive material during thermal treatment of the piezoelectric/electrostrictive layers 14*b*1 to 14*b*4; as a result, the composition of the piezoelectric/electrostrictive material varies with a resultant deterioration in the piezoelectric property.

Meanwhile, preferably, the electrodes 14*a*1 to 14*a*5 of the piezoelectric/electrostrictive elements 14 are formed from a metal that is solid at room temperature and has excellent electrical conductivity. Examples of the metal include aluminum, titanium, chromium, iron, cobalt, nickel, copper, zinc, niobium, molybdenum, ruthenium, palladium, rhodium, silver, tin, tantalum, tungsten, iridium, platinum, gold, lead, and an alloy of these metals. Furthermore, an electrode material can be a cermet material prepared by dispersing in any of the above metals a material identical with that of the piezoelectric/electrostrictive layers 14*b*1 to 14*b*4 or that of the thin-plate portions 12.

Selection of an electrode material for use in the piezoelectric/electrostrictive element 14 depends on a method of forming the piezoelectric/electrostrictive layers 14*b*1 to 14*b*4. For example, in the case where the electrode 14*a*1 is formed on the thin-plate portion 12, and then the piezoelectric/electrostrictive layer 14*b*1 is formed on the electrode 14*a*1 by means of firing, the electrode 14*a*1 must be formed of a high-melting-point metal, such as platinum, palladium, a platinum(palladium alloy, or a silver(palladium alloy, that remains intact even when exposed to a firing temperature of the piezoelectric/electrostrictive layer 14*b*1. This also applies to other electrodes (electrodes 14*a*2 to 14*a*4) whose formation is followed by firing of corresponding piezoelectric/electrostrictive layers.

By contrast, in the case of the outermost electrode 14*a*5 to be formed on the piezoelectric/electrostrictive layer 14*b*4, the formation of the electrode 14*a*5 is not followed by firing of a piezoelectric/electrostrictive layer. Thus, the electrode 14*a*5 can be formed from a low-melting-point metal, such as aluminum, gold, or silver.

Since the laminar electrodes 14*a*1 to 14*a*5 possibly cause a reduction in displacement of the piezoelectric/electrostrictive element 14, each of the electrode layers is desirably thin. Particularly, the electrode 14*a*5, which is formed after the piezoelectric/electrostrictive layer 14*b*4 is fired, is formed preferably from an organic metal paste, which enables the formation of a dense, very thin film after firing. Examples of the paste include a gold resinate paste, a platinum resinate paste, and a silver resinate paste.

Figure 4:
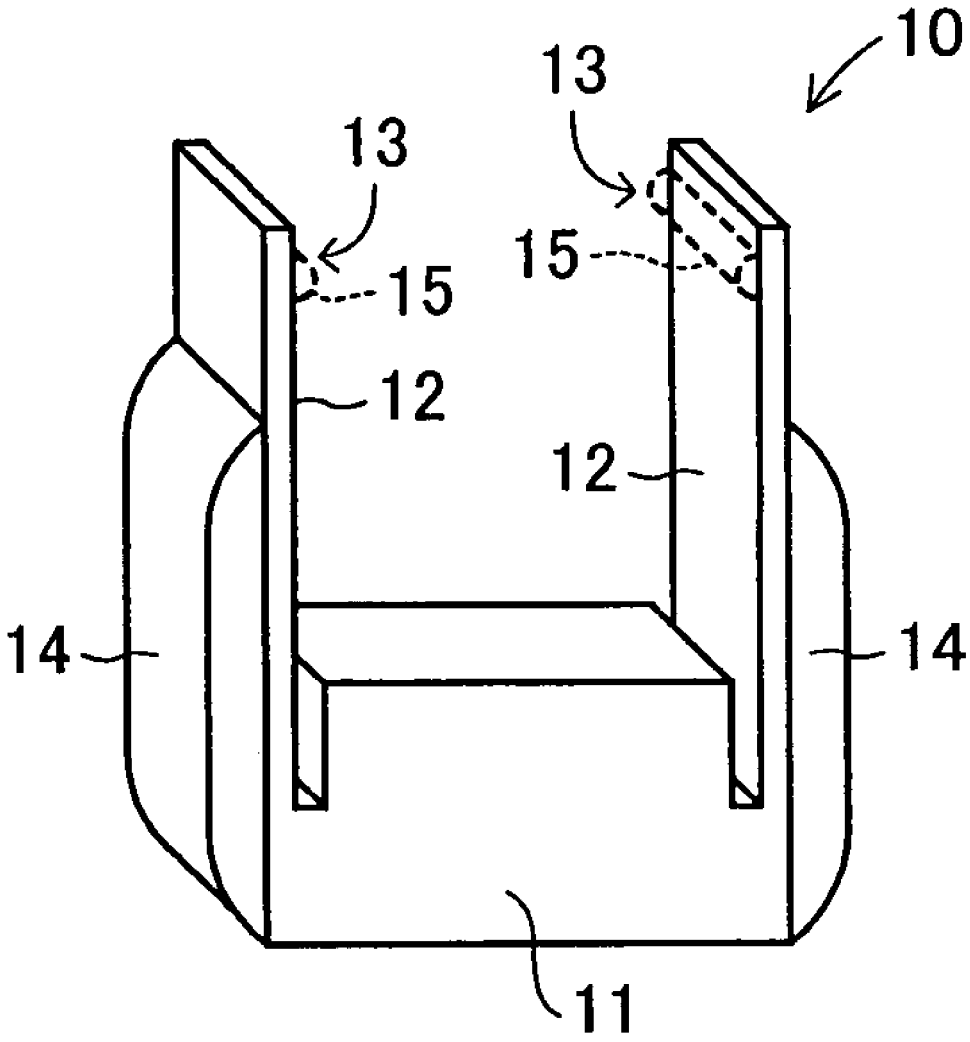
FIG. 4 is a perspective view of a variant of the piezoelectric/electrostrictive device of FIG. 1.

In the piezoelectric/electrostrictive device 10 of FIG. 1, the holding portions 13, which are formed integrally with the corresponding tip end portions of the thin-plate portions 12, have a thickness greater than the thickness Dd of the thin-plate portions 12. However, as shown in FIG. 4, the holding portions 13 may have a thickness substantially equal to that of the thin-plate portions 12. As a result, an object to be held between the holding portions 13 can have a size corresponding to the distance between the thin-plate portions 12. In this case, regions where an adhesive is applied in order to hold the object virtually serves as the corresponding holding portions 13. Furthermore, in this case, as represented by the broken line in FIG. 4, a pair of projections 15 for specifying the regions where an adhesive is applied may be provided. Desirably, such the projections 15 are formed from the same material as that of the thin-plate portions 12 and integrally with the thin-plate portions 12 by means of monolithic sintering or monolithic molding.

The above-mentioned piezoelectric/electrostrictive device 10 can also be used as an ultrasonic sensor, an acceleration sensor, an angular-velocity sensor, an impact sensor, a mass sensor, or a like sensor. In application to such a sensor, the piezoelectric/electrostrictive device 10 is advantageous in that sensor sensitivity can be readily adjusted by means of appropriately adjusting the size of an object to be held between the opposed holding portions 13 or between the opposed thin-plate portions 12.

Next, a method for manufacturing the above-mentioned piezoelectric/electrostrictive device 10 will be described. Preferably, a substrate portion (which excludes the piezoelectric/electrostrictive elements 14; i.e., which includes the stationary portion 11, the thin-plate portions 12, and the holding portions 13) of the piezoelectric/electrostrictive device 10 is manufactured by a ceramic green sheet lamination process. Meanwhile, preferably, the piezoelectric/electrostrictive elements 14 are manufactured by a film formation process, which is adapted to form a thin film, a thick film, and a like film.

A ceramic green sheet lamination process allows integral formation of members of the substrate portion of the piezoelectric/electrostrictive device 10. Thus, the employment of a ceramic green sheet lamination process allows a joint portion between members to be almost free from a change in state with time, thereby enhancing the reliability of joint portions and securing rigidity. In the case where the substrate portion is formed by laminating metallic plates, the employment of a diffusion joining process allows a joint portion between members to be almost free from a change in state with time, thereby securing the reliability of joint portions, and rigidity.

In the piezoelectric/electrostrictive device 10 of FIG. 1 according to the present embodiment, boundary portions (joint portions) between the thin-plate portions 12 and the stationary portion 11, and boundary portions (joint portions) between the thin-plate portions 12 and the corresponding holding portions 13 serve as fulcrum points for manifestation of displacement. Therefore, the reliability of the joint portions is an important factor that determines the characteristics of the piezoelectric/electrostrictive device 10.

A manufacturing method to be described below features high productivity and excellent formability and thus can yield the piezoelectric/electrostrictive devices 10 having a predetermined shape in a short period of time with good reproducibility. In the following description, a laminate obtained by laminating a plurality of ceramic green sheets is defined as a ceramic green sheet laminate 22 (see FIG. 6); and a monolithic body obtained by firing the ceramic green sheet laminate 22 is defined as a ceramic laminate 23 (see FIG. 7).

Figure 7:
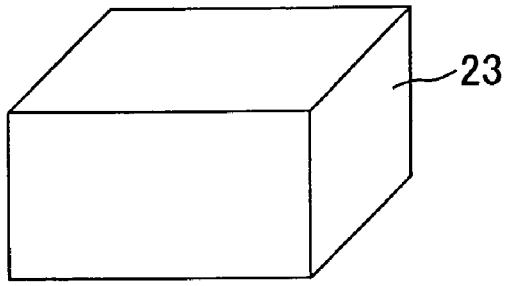
FIG. 7 is a perspective view of a ceramic laminate formed by monolithically firing the ceramic green sheet laminate of FIG. 6.

The manufacturing method is embodied desirably as follows: a single sheet equivalent to a plurality of ceramic laminates of FIG. 7 arranged lengthwise and crosswise is prepared; a laminate corresponding to a plurality of laminates 24 (see FIG. 8), which are formed into the piezoelectric/electrostrictive elements 14, is formed continuously on the surface (upper surface) of the sheet in predetermined regions; and the sheet is cut, whereby a plurality of piezoelectric/electrostrictive devices 10 are manufactured in the same process. Furthermore, desirably, two or more piezoelectric/electrostrictive devices 10 are yielded in association with a single window (including Wd1 and the like shown in FIG. 5). In order to simplify description, the following description discusses a method for obtaining a single piezoelectric/electrostrictive device 10 from a ceramic laminate by cutting the ceramic laminate 23.

First, a binder, a solvent, a dispersant, a plasticizer, and the like are mixed with a ceramic powder of zirconia or the like, thereby preparing a slurry. The slurry is defoamed. By use of the defoamed slurry, a rectangular ceramic green sheet having a predetermined thickness is formed by a reverse roll coater process, a doctor blade process, or a like process.

Figure 5:
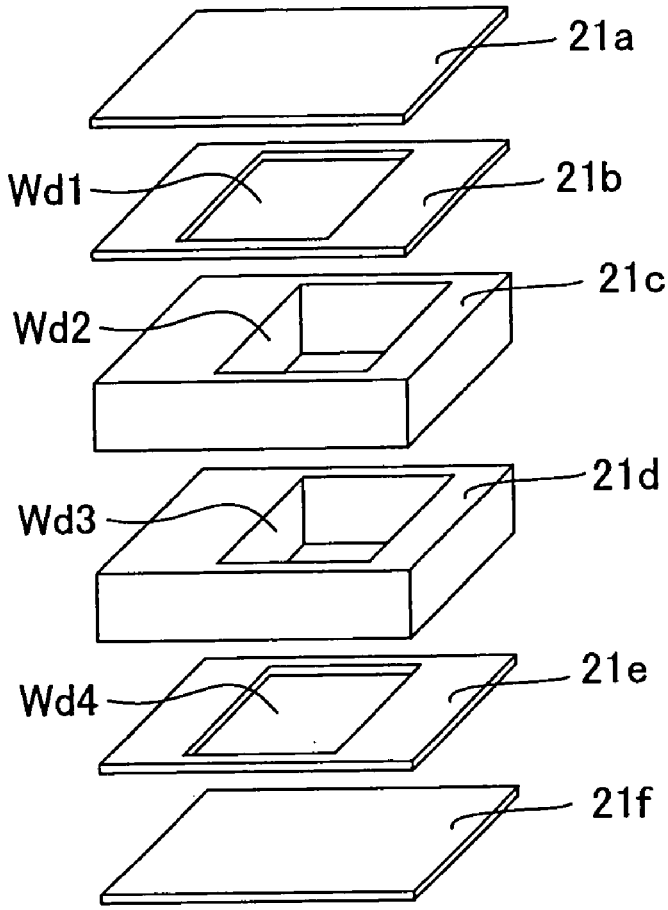
FIG. 5 is a perspective view of ceramic green sheets to be laminated for manufacturing a piezoelectric/electrostrictive device.

Next, as shown in FIG. 5, a plurality of ceramic green sheets 21*a* to 21*f* are formed from the above-prepared ceramic green sheet by blanking with a die, laser machining, or like machining.

In the example of FIG. 5, rectangular windows Wd1 to Wd4 are formed in the ceramic green sheets 21*b* to 21*e*, respectively. The windows Wd1 and Wd4 have substantially the same shape, and the windows Wd2 and Wd3 have substantially the same shape. Each of the ceramic green sheets 21*a* and 21*f* includes a portion that is formed into the thin-plate portion 12. Each of the ceramic green sheets 21*b* and 21*e* includes a portion that is formed into the holding portion 13. Notably, the number of ceramic green sheets is given merely as an example. In the illustrated example, the ceramic green sheets 21*c* and 21*d* may be replaced with a single green sheet having a predetermined thickness or with a plurality of ceramic green sheets to be laminated so as to obtain the predetermined thickness or with a green sheet laminate having the predetermined thickness.

Figure 6:
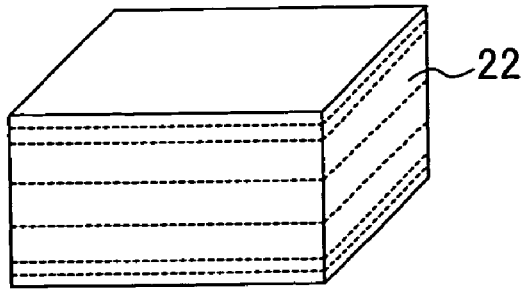
FIG. 6 is a perspective view of a ceramic green sheet laminate formed by laminating and compression-bonding the ceramic green sheets of FIG. 5.

Subsequently, as shown in FIG. 6, the ceramic green sheets 21*a* to 21*f* are laminated and compression-bonded to thereby form the ceramic green sheet laminate 22. Next, the ceramic green sheet laminate is fired to thereby form the ceramic laminate 23 shown in FIG. 7.

No particular limitations are imposed on the number and order of compression-bonding operations for forming the ceramic green sheet laminate 22 (for monolithic lamination). In the case where a portion to which pressure is not sufficiently transmitted by uniaxial application of pressure (application of pressure in a single direction), desirably, compression bonding is repeated a plurality of times, or impregnation with a pressure-transmitting substance is employed in compression bonding. Also, for example, the shape of the windows Wd1 to Wd4 and the number and thickness of ceramic green sheets can be determined as appropriate according to the structure and function of the piezoelectric/electrostrictive device 10 to be manufactured.

When the above compression bonding for monolithic lamination is performed while heat is applied, a more reliable state of lamination is obtained. When a paste, a slurry, or the like that contains a predominant amount of a ceramic powder and a binder and serves as a bonding aid layer is applied to ceramic green sheets by means of coating or printing before the ceramic green sheets are compression-bonded, the state of bonding at the interface between the ceramic green sheets can be enhanced. In this case, preferably, the ceramic powder to be used as a bonding aid has a composition identical with or similar to a ceramic used in the ceramic green sheets 21*a* to 21*f* in view of the reliability of bonding. Furthermore, in the case where the ceramic green sheets 21*a* and 21*f* are thin, the use of a plastic film (particularly, a polyethylene terephthalate film coated with a silicone-base parting agent) is preferred in handling the ceramic green sheets 21*a* and 21*f*. When the windows Wd1 and Wd4 and the like are to be formed in relatively thin sheets, such as the ceramic green sheets 21*b* and 21*e*, each of these sheets may be attached to the above-mentioned plastic film before a process for forming the windows Wd1 and Wd4 and the like is performed.

Figure 8:
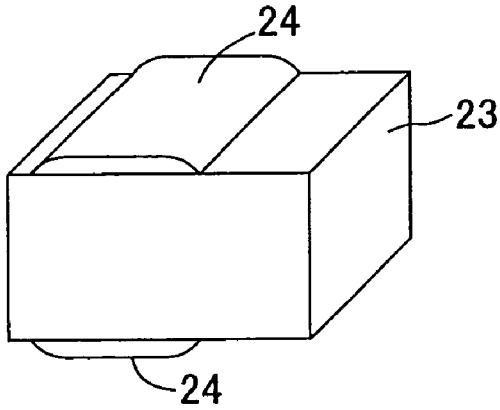
FIG. 8 is a perspective view of the ceramic laminate of FIG. 7 on which piezoelectric/electrostrictive laminates are formed.

Next, as shown in FIG. 8, the piezoelectric/electrostrictive laminates 24 are formed on the corresponding opposite sides of the ceramic laminate 23; i.e., on the corresponding surfaces of the fired ceramic green sheets 21*a* and 21*f*. Examples of methods for forming the piezoelectric/electrostrictive laminates 24 include thick-film formation processes, such as a screen printing process, a dipping process, a coating process, and an electrophoresis process; and thin-film formation processes, such as an ion beam process, a sputtering process, a vacuum deposition process, an ion plating process, a chemical vapor deposition (CVD) process, and a plating process.

The use of such a film formation process in formation of the piezoelectric/electrostrictive laminates 24 allows the piezoelectric/electrostrictive laminates 24 and the thin-plate portions 12 to be monolithically bonded (disposed), thereby securing reliability and reproducibility and facilitating integration.

In this case, more preferably, a thick-film formation process is used for forming the piezoelectric/electrostrictive laminates 24. A thick-film formation process allows, in film formation, the use of a paste, a slurry, a suspension, an emulsion, a sol, or the like that contains a predominant amount of piezoelectric ceramic particles or powder having an average particle size of 0.01 μm to 5 μm, preferably 0.05 μm to 3 μm. The piezoelectric/electrostrictive laminates 24 obtained by firing the thus-formed films exhibit a good piezoelectric/electrostrictive characteristic.

An electrophoresis process has such an advantage that a film can be formed with high density and high shape accuracy. A screen printing process can simultaneously perform control of film thickness and pattern formation and thus can simplify a manufacturing process.

An example method for forming the ceramic laminate 23 and the piezoelectric/electrostrictive laminates 24 will be described in detail. First, the ceramic green sheet laminate 22 is monolithically fired at a temperature of 1,200° C. to 1,600° C., thereby yielding the ceramic laminate 23 shown in FIG. 7. Subsequently, as shown in FIG. 3, the bottom electrodes 14*a*1 are printed on the corresponding opposite sides of the ceramic laminate 23 at a predetermined position, followed by firing. Next, the piezoelectric/electrostrictive layers 14*b*1 and then the electrodes 14*a*2 are printed on the electrodes 14*a*1, followed by simultaneous firing. Subsequently, similarly, a process in which a single piezoelectric/electrostrictive layer and then a single electrode are printed and then simultaneously fired is repeated two times. Subsequently, the piezoelectric/electrostrictive layers 14*b*4 are printed and then fired. Next, the top electrodes 14*a*5 are printed and then fired, thereby forming the piezoelectric/electrostrictive laminates 24. Subsequently, a terminal (not shown) for electrically connecting the electrodes 14*a*1, 14*a*3, and 14*a*5 to a drive circuit, and a terminal (not shown) for electrically connecting the electrodes 14*a*2 and 14*a*4 to the drive circuit are printed and fired.

Alternatively, the piezoelectric/electrostrictive laminates 24 may be formed as follows. The bottom electrodes 14*a*1 are printed and fired. Next, the piezoelectric/electrostrictive layers 14*b*1 are printed and fired. On the piezoelectric/electrostrictive layers 14*b*1, the respective electrodes 14*a*2 are printed and then fired. Subsequently, a process in which individual piezoelectric/electrostrictive layers and individual electrodes are alternatingly printed and then fired is repeated three times.

In this case, for example, the electrodes 14*a*1, 14*a*2, 14*a*3, and 14*a*4 are formed from a material that contains a predominant amount of platinum (Pt); the piezoelectric/electrostrictive layers 14*b*1 to 14*b*4 are formed from a material that contains a predominant amount of lead zirconate titanate (PZT); the electrode 14*a*5 is formed from gold (Au); and the terminals are formed from silver (Ag). In this manner, materials are selected in such a manner that their firing temperature lowers in the ascending order of lamination. As a result, at a certain firing stage, a material(s) that has been fired is free from re-sintering, thereby avoiding occurrence of a problem, such as the exfoliation or cohesion of an electrode material.

The selection of appropriate materials allows the members of the piezoelectric/electrostrictive laminates 24 and the terminals to be sequentially printed and then monolithically fired in a single firing operation. Also, the piezoelectric/electrostrictive laminate 24 may be formed as follows: a firing temperature for the outermost piezoelectric/electrostrictive layer 14*b*4 is set higher than that for the piezoelectric/electrostrictive layers 14*b*1 to 14*b*3, so as to finally bring the piezoelectric/electrostrictive layers 14*b*1 to 14*b*4 into the same sintered state.

The members of the piezoelectric/electrostrictive laminates 24 and the terminals may be formed by a thin-film formation process, such as a sputtering process or a vapor deposition process. In this case, heat treatment is not necessarily required.

The following simultaneous firing process may be employed. The piezoelectric/electrostrictive laminates 24 are formed on the corresponding opposite sides of the ceramic green sheet laminate 22; i.e., on the corresponding surfaces of the ceramic green sheets 21*a* and 21*f*. Subsequently, the ceramic green sheet laminate 22 and the piezoelectric/electrostrictive laminates 24 are simultaneously fired.

In an example method for simultaneously firing the piezoelectric/electrostrictive laminates 24 and the ceramic green sheet laminate 22, precursors of the piezoelectric/electrostrictive laminates 24 are formed by a tape formation process using a slurry material, or a like process; the precursors of the piezoelectric/electrostrictive laminates 24 are laminated on the corresponding opposite sides of the ceramic green sheet laminate 22 by thermo-compression bonding or the like; and subsequently the precursors and the ceramic green sheet laminate 22 are simultaneously fired. However, in this method, the electrodes 14*a*1 must be formed beforehand on the corresponding opposite sides of the ceramic green sheet laminate 22 and/or on the corresponding piezoelectric/electrostrictive laminates 24 by use of any film formation process mentioned above.

In another method, the electrodes 14*a*1 to 14*a*5 and the piezoelectric/electrostrictive layers 14*b*1 to 14*b*4, which are component layers of the piezoelectric/electrostrictive laminates 24, are screen-printed at least on those portions of the ceramic green sheet laminate 22 which are finally formed into the corresponding thin-plate portions 12; and the component layers and the ceramic green sheet laminate 22 are simultaneously fired.

A firing temperature for a component layer of the piezoelectric/electrostrictive laminates 24 depends on the material of the component layer, but is generally 500° C. to 1,500° C. A preferred firing temperature for the piezoelectric/electrostrictive layers 14*b*1 to 14*b*4 is 1,000° C. to 1,400° C. In this case, preferably, in order to control the composition of the piezoelectric/electrostrictive layers 14*b*1 to 14*b*4, sintering is performed in such a state that evaporation of the material of the piezoelectric/electrostrictive layers 14*b*1 to 14*b*4 is controlled (for example, in the presence of an evaporation source). In the case where the piezoelectric/electrostrictive layers 14*b*1 to 14*b*4 and the ceramic green sheet laminate 22 are simultaneously fired, their firing conditions must be compatible with each other. The piezoelectric/electrostrictive laminates 24 are not necessarily formed on the corresponding opposite sides of the ceramic laminate 23 or the ceramic green sheet laminate 22, but may be formed only on a single side of the ceramic laminate 23 or the ceramic green sheet laminate 22.

Next, unnecessary portions are cut away from the ceramic laminate 23 on which the piezoelectric/electrostrictive laminates 24 are formed as described above. Specifically, the ceramic laminate 23 and the piezoelectric/electrostrictive laminates 24 are cut along cutting lines (broken lines) C1 to C4 shown in FIG. 9. Cutting can be performed by mechanical machining, such as wire sawing or dicing, as well as laser machining, such as YAG laser machining or excimer laser machining, or electron beam machining.

Figure 9:
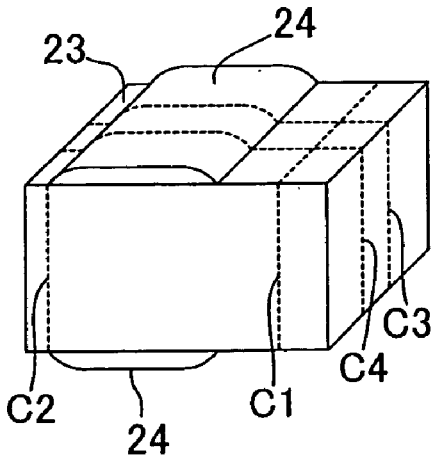
FIG. 9 is a view showing a cutting step for cutting the ceramic laminate and the piezoelectric/electrostrictive laminates shown in FIG. 8.

Cutting the ceramic laminate 23 and the piezoelectric/electrostrictive laminates 24 along the cutting lines (broken lines) C3 and C4 of FIG. 9 includes cutting of the components of the piezoelectric/electrostrictive laminates 24; i.e., cutting of piezoelectric/electrostrictive layers which are relatively low in strength and fragile, and a metal which is ductile. Thus, machining that imposes a small machining load on an object to be cut (hereinafter, a "monolithic body including the ceramic laminate 23 and the piezoelectric/electrostrictive laminate 24," which partially constitutes the piezoelectric/electrostrictive device 10, is also referred to as an "object to be cut") is desirable. Particularly, wire sawing is suited for such cutting, since wire sawing is suited for simultaneously forming a plurality of piezoelectric/electrostrictive devices 10 by means of simultaneous cutting and is small in machining load. Desirably, a dicing cutter is used to cut the ceramic laminate 23 along the cutting lines C1 and C2 (represented by the broken line) shown in FIG. 9.

The above-mentioned object to be cut is not directly mounted to a wire-sawing or dicing stage. Generally, the object to be cut is bonded to a jig by use of wax, an adhesive, or the like, and the jig is mounted to the wire-sawing or dicing stage. Desirably, a cut base (a base plate; a member to be cut together with the object to be cut), such as a plate of glass or silicon wafer, a plate of an organic resin (PET, PC, PE, PP, or the like), or film or a like thin plate of such an organic resin, is interposed between the jig and the object to be cut. In this case, desirably, an adhesive used for bonding the object to be cut and the cut base, and a adhesive used for bonding the cut base and the jig differ in mutual solubility with respect to respectively predetermined solvents.

Selection of such adhesives can prevent a solvent used for separating the cut base and the jig from affecting a bond between the cut base and a cut object. Thus, after the cut base and the jig are separated from each other, the cut object can be handled while being bonded to the cut base. For example, when abrasive grains which adhere, during wire sawing, to the object to be cut are to be cleaned off, an operation of setting (placing) the cut object in a cleaning jig is facilitated by employment of the following practice: the cut object bonded to the cut base is placed in the cleaning jig at a predetermined position and then cleaned, and subsequently the cut base and the cut object are separated from each other in the cleaning jig. As described above, the piezoelectric/electrostrictive device 10 shown in FIG. 1 is manufactured by cutting the ceramic laminate 23 and the piezoelectric/electrostrictive laminates 24 along the cutting lines C1 to C4 shown in FIG. 9.

Next will be described an example process for inspecting whether or not the above-manufactured piezoelectric/electrostrictive device 10 is nondefective. In order to inspect the piezoelectric/electrostrictive device 10 for conformance, it must be judged whether or not a vibration characteristic (dynamic characteristic of the piezoelectric/electrostrictive device 10) and the relationship between voltage applied between the electrodes of the piezoelectric/electrostrictive element 14 and the quantity of displacement of the holding portions 13 (static characteristic of the piezoelectric/electrostrictive device 10) meet respective requirements. However, it is difficult to directly measure the quantity of displacement of the holding portions 13.

The piezoelectric/electrostrictive device 10 has such a characteristic that, when the same voltage is applied between the electrodes, the greater the capacitance of the piezoelectric/electrostrictive element 14, the greater the quantity of displacement of the holding portions 13. In other words, judging whether or not the capacitance of the piezoelectric/electrostrictive element 14 falls within a predetermined range can be equivalent to judging whether or not the static characteristic of the piezoelectric/electrostrictive device 10 falls within a predetermined range.

Since the resonance frequency of the piezoelectric/electrostrictive device 10 is closely related to the dynamic characteristic of the piezoelectric/electrostrictive device 10, the resonance frequency can be an effective indicator for judging the dynamic characteristic. In other words, judging whether or not the resonance frequency of the piezoelectric/electrostrictive device 10 falls within a predetermined range can be equivalent to judging whether or not the dynamic characteristic of the piezoelectric/electrostrictive device 10 falls within a predetermined range.

Thus, in the present embodiment, a predetermined, known polarization process is performed on the two piezoelectric/electrostrictive elements 14. Then, the capacitance of the two piezoelectric/electrostrictive elements 14 and the resonance frequency of the piezoelectric/electrostrictive device 10 are measured. The capacitance of the two piezoelectric/electrostrictive elements 14 can be measured, for example, as follows. While voltage applied between the electrodes is being changed from "0" to a predetermined value, current flowing to the electrodes is measured. Measured current is integrated with respect to time to thereby estimate the quantity of charge charged in the electrodes, and the capacitance of the two piezoelectric/electrostrictive elements 14 is determined on the basis of the quantity of charge.

The resonance frequency of the piezoelectric/electrostrictive device 10 can be measured, for example, as follows. When voltage having a constant amplitude is applied to the two piezoelectric/electrostrictive elements 14 while the frequency of voltage is gradually increased, a periodical change in the quantity of charge charged in the electrodes is analyzed by use of FFT. The frequency of voltage when resonance occurs with respect to the quantity of charge is measured as the resonance frequency of the piezoelectric/electrostrictive device 10.

On the basis of the measured capacitance of the two piezoelectric/electrostrictive elements 14 and the measured resonance frequency of the piezoelectric/electrostrictive device 10, whether or not static and dynamic characteristics of the piezoelectric/electrostrictive device 10 fall within respectively predetermined ranges is judged. Only when both of static and dynamic characteristics are judged to fall within the respectively predetermined ranges, the piezoelectric/electrostrictive device 10 is judged to be nondefective. The above is an example process for inspecting whether or not the piezoelectric/electrostrictive device 10 is nondefective.

Next will be described an example process for simultaneously manufacturing a plurality of piezoelectric/electrostrictive devices similar to the piezoelectric/electrostrictive devices 10. A single worksheet (hereinafter generically called a "worksheet WS") is prepared. The worksheet WS is equivalent to a plurality of objects to be cut (hereinafter generically called an "objects HS to be cut") arranged in columns and rows. The objects HS to be cut are similar to the above-mentioned objects to be cut. The worksheet WS (a collection of objects HS to be cut) is subjected to cutting, thereby yielding the plurality of piezoelectric/electrostrictive devices.

Figure 10:
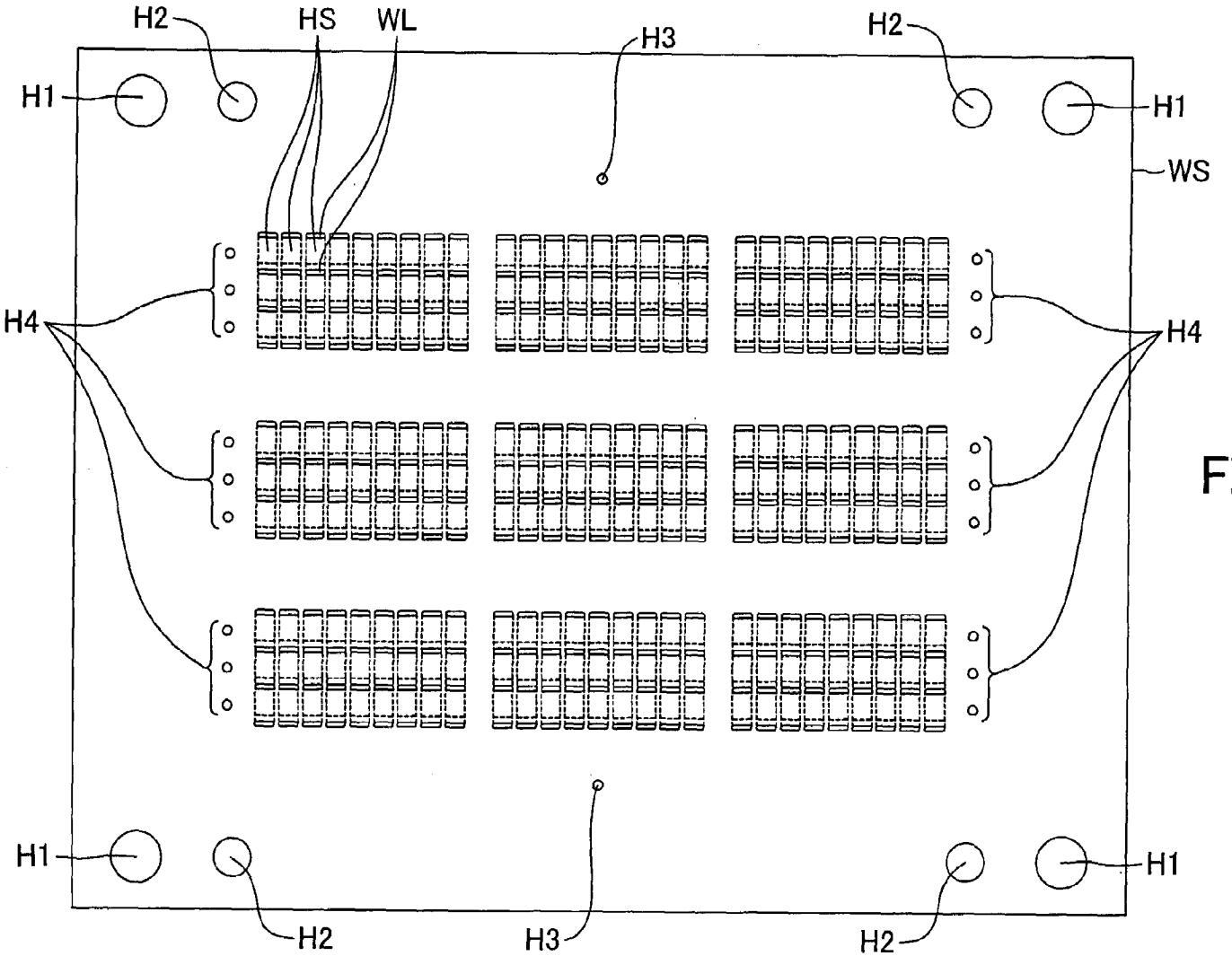
FIG. 10 is a top view of a worksheet in which a plurality of objects to be cut are arranged in columns and rows.

FIG. 10 is a top view of a worksheet WS in which nine blocks are arranged in three columns and three rows, each block including 27 objects HS to be cut arranged in three columns and nine rows. In the present example, the worksheet WS is equivalent to a plurality of the previously described ceramic laminates 23 (sintered bodies before the piezoelectric/electrostrictive laminates 24 are formed thereon by printing) arranged in columns and rows.

Windows WL (through holes) for determining the overall length of individual piezoelectric/electrostrictive devices (equivalent to the length between the end of the holding portion 13 and the end of the stationary portion 11 in the piezoelectric/electrostrictive device 10) are formed in the worksheet WS and located at longitudinally opposite end portions of individual objects HS to be cut. At a stage of preparing ceramic green sheets used to form the worksheet WS, holes of the same shape corresponding to the windows WL are formed in the ceramic green sheets. When the ceramic green sheets are laminated, the holes are also laminated, thereby forming the windows WL.

Through employment of the windows WL, the overall length of the piezoelectric/electrostrictive device can be determined, not by cutting the worksheet WS along the lateral direction by means of dicing or the like, but by machining the ceramic green sheets. As compared with the case of cutting the thick sintered body (worksheet WS), overall length can be uniformly determined among products (the overall length can be accurately determined).

The worksheet WS has various register holes formed therein at predetermined positions. The register holes are lamination register holes H1, which are used when the above-mentioned ceramic green sheets are laminated; printing register holes H2, which are used to determine printing positions when components (electrodes and piezoelectric/electrostrictive layers) of piezoelectric/electrostrictive laminates are printed; machining register holes H3, which are used to determine machining positions when lateral cutting by means of dicing or longitudinal cutting by means of wire sawing is performed; and machining register holes H4, which are used to determine machining positions when longitudinal cutting by means of wire sawing is performed. The functional difference between the machining register holes H3 and the machining register holes H4 will be described later.

As in the case of the windows WL, at a stage of preparing ceramic green sheets used to form the worksheet WS, holes of the same shape corresponding to the lamination register holes H1, those corresponding to the printing register holes H2, those corresponding to the machining register holes H3, and those corresponding to the machining register holes H4 are formed in the ceramic green sheets. When the ceramic green sheets are laminated, the holes are also laminated, thereby forming the register holes H1 to H4. All of the register holes H1 to H4 are cylindrical through holes. At individual stages of working, relevant register holes are fitted to corresponding cylindrical register pins that are provided on the top surface of a stage in a vertically standing condition, whereby the register holes perform the above-mentioned functions.

Among holes that are formed in the ceramic green sheets and are to be formed into the printing register holes H2 through lamination of the ceramic green sheets, holes formed in the ceramic green sheets (equivalent to the ceramic green sheets 21*a* and 21*f* in FIG. 5) associated with thin-plate portions corresponding to the thin-plate portions 12 are slightly smaller in diameter than holes formed in the remaining ceramic green sheets. This is for the following reason.

The printing position of piezoelectric/electrostrictive elements on corresponding thin-plate portions greatly influences the operating characteristics of a piezoelectric/electrostrictive device. Accordingly, the printing position of the piezoelectric/electrostrictive elements on the thin-plate portions must be accurately determined. To meet this requirement, when register pins are inserted into the corresponding printing register holes H2, the register pins must make reliable contact with the inner wall surfaces (portions of the inner wall surfaces) of the holes formed in the ceramic green sheets associated with the thin-plate portions.

Meanwhile, in actuality, it is impossible to form holes of completely the same shape in a plurality of ceramic green sheets at completely the same position. Accordingly, in actuality, holes that are formed in the ceramic green sheets and are to be formed into each of the printing register holes H2 through lamination of the ceramic green sheets differ in, for example, diameter and position. As a result, the actual inner wall surface of the printing register hole H2 is ragged. Thus, if the same diameter (the same target diameter) is imparted to the holes that are formed in the ceramic green sheets and are to be formed into each of the printing register holes H2 through lamination of the ceramic green sheets, the register pin inserted into the printing register hole H2 may fail to come into contact with the inner wall surfaces of holes formed in the ceramic green sheets associated with the thin-plate portions; in other words, the register pin may come into contact with only the inner wall surfaces of holes formed in the ceramic green sheets other than those associated with the thin-plate portions. As a result, the accuracy in the printing position of the piezoelectric/electrostrictive elements on the thin-plate portions potentially drops.

In order to avoid the above problem and ensure that the register pins inserted into the printing register holes H2 come into contact with the inner wall surfaces of those holes formed in the ceramic green sheets associated with the thin-plate portions, the present embodiment takes the following measure: among holes that are formed in the ceramic green sheets and are to be formed into the printing register holes H2 through lamination of the ceramic green sheets, holes formed in the ceramic green sheets associated with thin-plate portions are rendered slightly smaller in diameter than holes formed in the remaining ceramic green sheets.

In the case where a projection equivalent to a projection 15 depicted by the broken line in FIG. 4 is provided on a thin-plate portion, the position of the projection on the thin-plate portion also greatly influences the operating characteristics of a piezoelectric/electrostrictive device, since the projections determine the position of an object S to be held therebetween. Accordingly, when printing is used to form the projections, the printing positions of the projections on the thin-plate portions must be determined at high accuracy.

Figure 11:
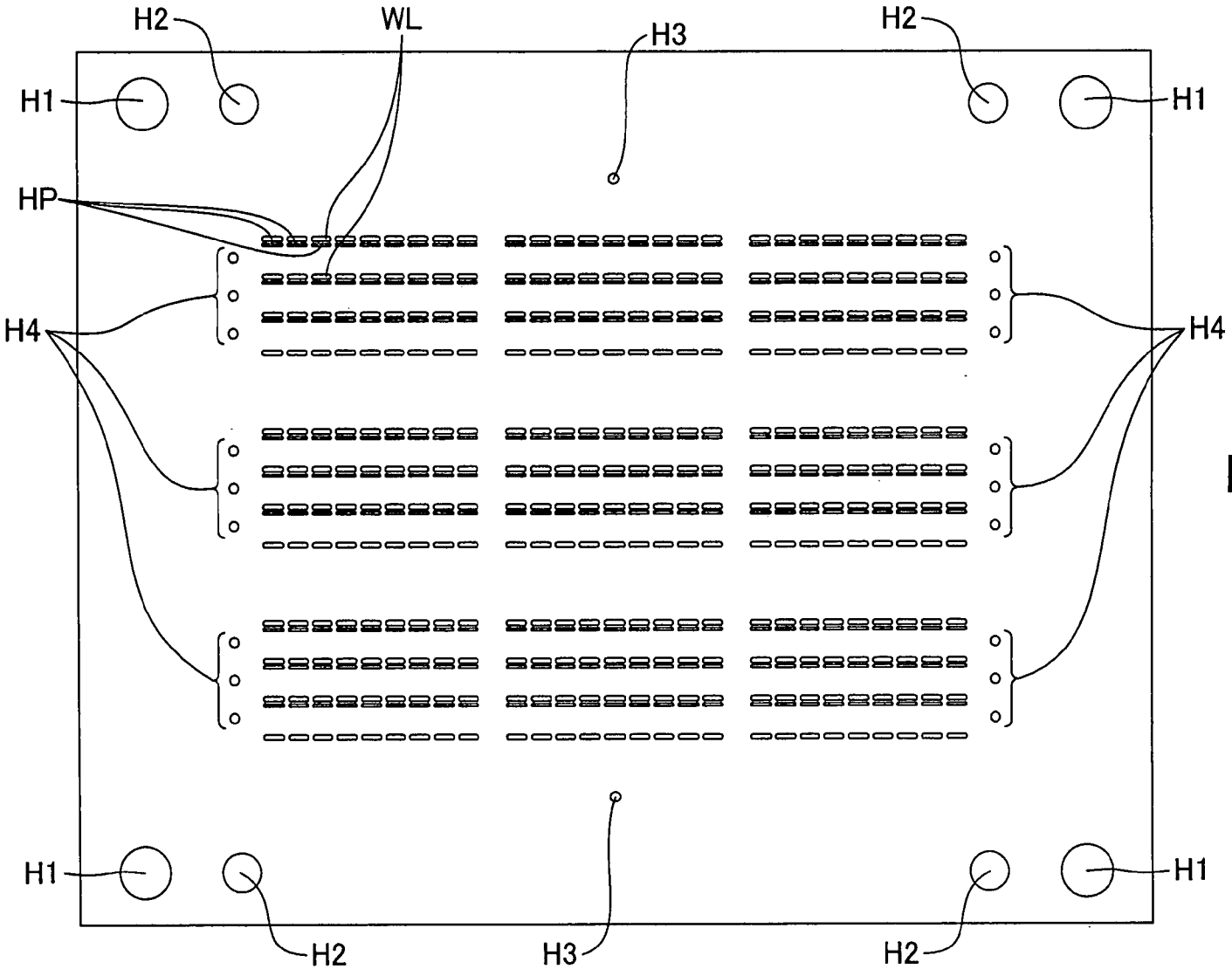
FIG. 11 is a top view of a ceramic green sheet associated with thin-plate portions and being one of a plurality of ceramic green sheets used to form the worksheet shown in FIG. 10.

FIG. 11 is a top view of a ceramic green sheet (equivalent to the ceramic green sheet 21*a* or 21*f* in FIG. 5) associated with thin-plate portions, the ceramic green sheet being one of a plurality of ceramic green sheets used to form, through lamination thereof, the worksheet WS shown in FIG. 10. At a stage before lamination and firing, a plurality of projections HP are printed on the ceramic green sheet at predetermined positions arranged in columns and rows. When the projections HP are to be printed on the green sheet, the printing positions of the projections HP are determined as follows: register pins are inserted into holes (the above-mentioned holes having a smaller diameter) that are formed in the ceramic green sheet and are to partially constitute the corresponding printing register holes H2. As a result, the printing positions of the projections HP on the thin-plate portions can be accurately determined.

Referring back to FIG. 10, in order to obtain a large number of piezoelectric/electrostrictive devices from the worksheet WS, first, a plurality of piezoelectric/electrostrictive laminates equivalent to the piezoelectric/electrostrictive laminates 24 are printed on the worksheet WS (on the corresponding objects HS to be cut) at predetermined positions arranged in columns and rows. The resultant worksheet WS is subjected to firing. Then, for example, the worksheet WS is cut laterally along cutting planes corresponding to a plurality of rows of windows WL by means of dicing. Subsequently, the worksheet WS is cut longitudinally at a plurality of columns of objects HS to be cut along cutting planes corresponding to the cutting lines C3 and C4 of FIG. 9 by means of wire sawing. In this case, desirably, wire sawing is performed so as to obtain two or more piezoelectric/electrostrictive devices from a single object HS to be cut. Thus, a large number of piezoelectric/electrostrictive devices are obtained.

Figure 12:
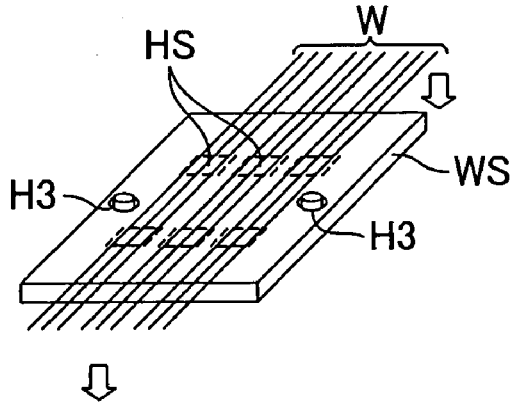
FIG. 12 is a view showing a case in which the entire worksheet is subjected to wire sawing so as to obtain piezoelectric/electrostrictive devices from a plurality of objects to be cut arranged in columns and rows in the worksheet.

Next, the functional difference between the machining register holes H3 and the machining register holes H4 will be described. FIG. 12 shows a case in which the entire worksheet WS is subjected to wire sawing so as to obtain piezoelectric/electrostrictive devices from a plurality of objects HS to be cut arranged in columns and rows in the worksheet WS. As shown in FIG. 12, in this example, two piezoelectric/electrostrictive devices are obtained from a single object HS to be cut. In this manner, when the entire worksheet WS is to be subjected to wire sawing, register holes equivalent to the machining register holes H3 shown in FIG. 10 are fitted to respective register pins, thereby determining wire sawing positions.

FIG. 13 shows a case in which predetermined portions (hereinafter generically called "workpieces ws") that are cut beforehand from the worksheet WS are subjected to wire sawing, whereby piezoelectric/electrostrictive devices are obtained from a plurality of objects HS to be cut arranged in columns and rows in the worksheet WS.

Figure 13A:
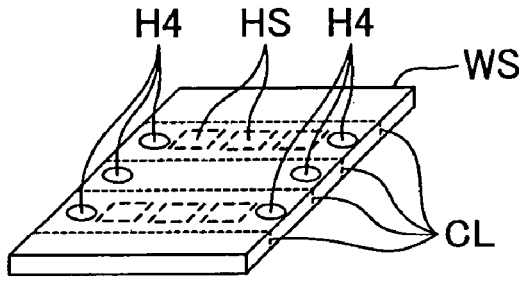
FIGS. 13A and 13B are views showing a case in which workpieces that are cut beforehand from the worksheet are subjected to wire sawing, whereby piezoelectric/electrostrictive devices are obtained from a plurality of objects to be cut arranged in columns and rows in the worksheet.
Figure 13B:
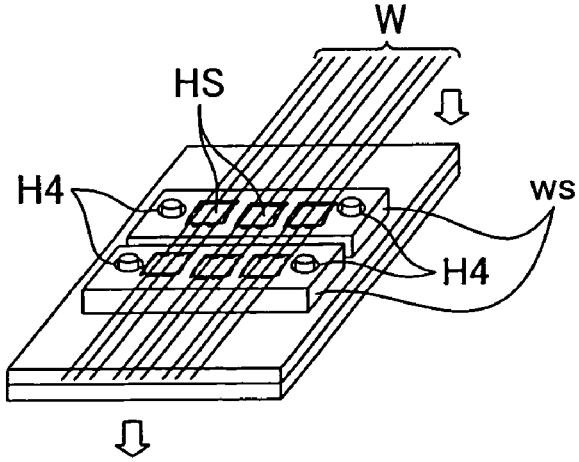

First, as shown in FIG. 13A, the worksheet WS is cut along a plurality of planes extending along cutting lines CL by means of dicing or the like so as to cut off a plurality of workpieces ws each including register holes equivalent to the machining register holes H4 shown in FIG. 10. Next, among the workpieces ws obtained by such cutting, the workpieces ws that do not include the objects HS to be cut are removed; i.e., the workpieces ws that include the objects HS to be cut are selected. Subsequently, as shown in FIG. 13B, a plurality of workpieces ws that include the objects HS to be cut are arranged adjacently to one another in a column while their register holes equivalent to the machining register holes H4 shown in FIG. 10 are fitted to respective register pins. The thus-arranged workpieces ws are subjected to wire sawing. Also, in this example, two piezoelectric/electrostrictive devices are obtained from a single object HS to be cut. In this manner, when the workpieces ws that are cut from the worksheet WS are to be subjected to wire sawing, register holes (provided on the individual workpieces ws) equivalent to the machining register holes H4 shown in FIG. 10 are fitted to respective register pins, thereby determining wire sawing positions. The above is the functional difference between the machining register holes H3 and the machining register holes H4 shown in FIG. 10.

Figure 14:
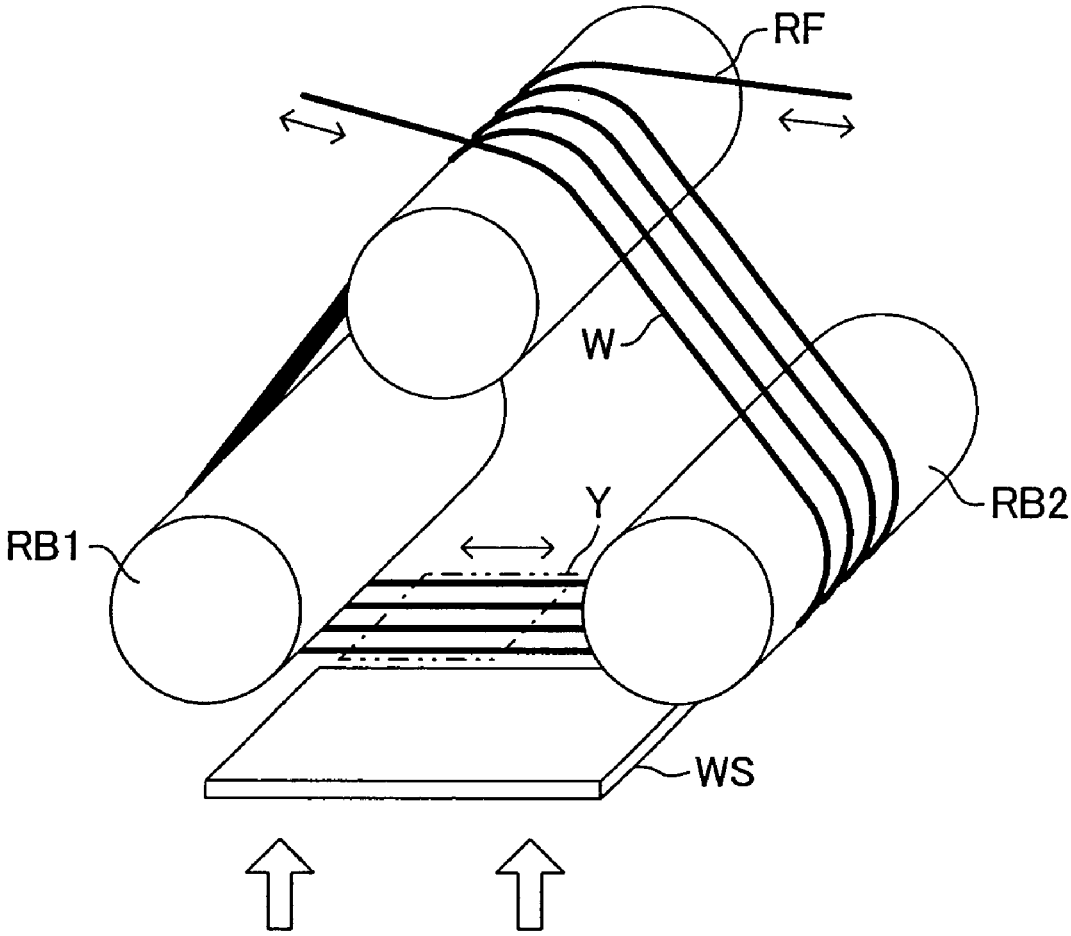
FIG. 14 is a schematic perspective view showing major components of a general wire saw.

Next, an embodiment of a wire sawing apparatus (a wire sawing method) to be employed for performing the above-mentioned wire sawing will be described with reference to FIGS. 14 to 16. FIG. 14 is a schematic perspective view showing major components of the wire saw. As shown in FIG. 14, the wire sawing apparatus includes a single wire feed roller RF and a pair of (two) basic rollers RB1 and RB2. The three rollers have the same diameter.

The three rollers are arranged such that their axes of rotation are in parallel with one another and such that, on the front view, the axes of rotation are located at the vertexes of a regular triangle. A plurality of circumferential grooves (cutting-positioning circumferential grooves) are provided on the surface of each of the paired basic rollers RB1 and RB2 and arranged in the axial direction such that the cutting-positioning circumferential grooves of the basic roller RB1 and the corresponding cutting-positioning circumferential grooves of the basic roller RB2 are paired and located at the same axial positions. A plurality of wire-feeding circumferential grooves are provided on the surface of the wire feed roller RF and arranged at a plurality of predetermined positions with respect to the axial direction.

A single wire W is wound a plurality of turns on the three rollers in such a spiral condition that the wire W extend at least between the paired cutting-positioning circumferential grooves and that the wire W is fitted into the circumferential grooves of the three rollers in an axially sequential manner. Accordingly, a plurality of linear portions Y of the wire W extending between the paired basic rollers RB1 and RB2 are in parallel with one another.

When the worksheet WS (an object to be cut) is to be subjected to wire sawing by use of the wire sawing apparatus, first, the worksheet WS is disposed on a machining stage. Next, by use of an unillustrated drive apparatus, opposite ends of the wire W are caused to reciprocate in the directions of the fine-line arrows shown in FIG. 14. Accordingly, while the three rollers are caused to alternatingly rotate forward and backward, the plurality of linear portions Y are caused to reciprocate in the directions of the fine-line arrow (in the horizontal directions). While the position of the three rollers is fixed, the machining stage is moved in the direction of the inline arrows (vertically upward) by use of an unillustrated drive apparatus. The upward movement of the machining stage causes the plurality of linear portions Y to cut into the worksheet WS, thereby cutting the worksheet WS simultaneously at a plurality of positions. In this case, the wire sawing apparatus may be configured such that, while the machining stage is fixed, the position of the three rollers is moved downward.

Next will be described the relationship between the axial positions of the wire-feeding circumferential grooves formed on the wire feed roller RF and an impairment in wire sawing accuracy. FIG. 15 shows winding of the wire W on the basic rollers RB1 and RB2 and on the wire feed roller RF in the case where pairs of cutting-positioning circumferential grooves g1 to g9 formed on the basic rollers RB1 and RB2 and corresponding wire-feeding circumferential grooves h1 to h9 are provided at the same axial positions, respectively (FIG. 15A is a front view, and FIG. 15B is a right side view).

Figure 15B:
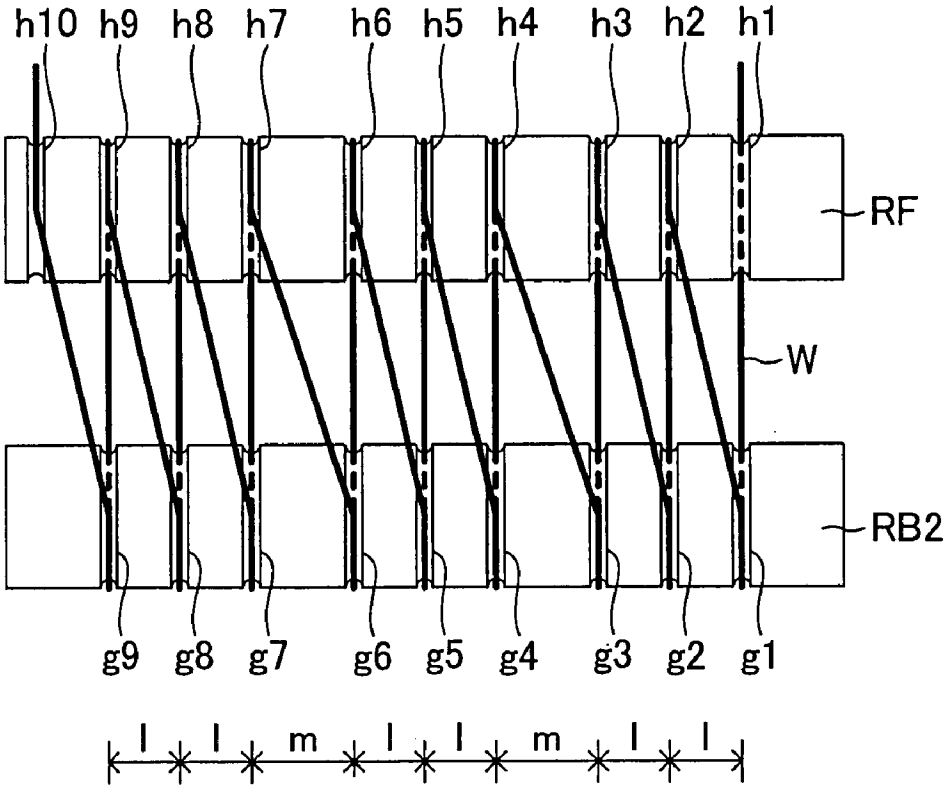
FIGS. 15A and 15B are views showing winding of a wire on three rollers of the general wire saw.
Figure 15A:
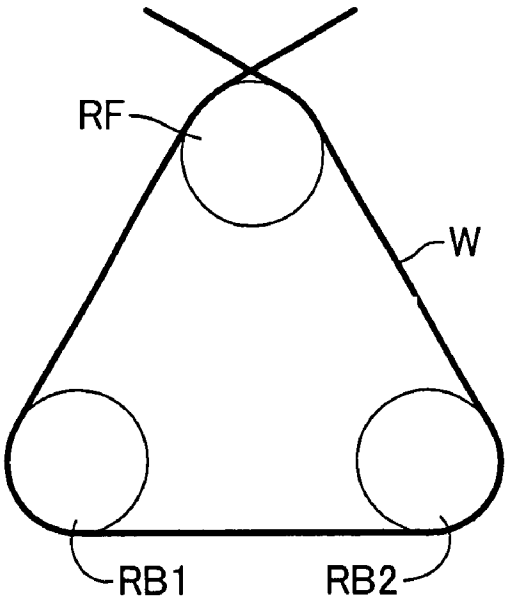

As shown in FIG. 15B, in this case, the wire W is fitted into the wire-feeding circumferential groove h1, next into a pair of cutting-positioning circumferential grooves g1, then into the wire-feeding circumferential groove h2, subsequently into a pair of cutting-positioning circumferential grooves g2, and so on. This winding operation is repeated in the axial direction (leftward in FIG. 15B), thereby spirally winding the wire W on the three rollers. The axial distance between adjacent cutting-positioning circumferential grooves is as follows: distance m between the circumferential grooves g3 and g4; distance m between the circumferential grooves g6 and g7; and distance I between the remaining circumferential grooves (m>I).

In this case, opposite end portions of each of linear portions of the wire W extending between the wire feed roller RF and the basic roller RB1 are located at the same axial position; in other words, the linear portions extend perpendicular to the axial direction. Accordingly, the tension of the wire W does not induce an axial force that acts on the basic roller RB1 at the cutting-positioning circumferential grooves g1 to g9.

Meanwhile, linear portions of the wire W extending between the wire feed roller RF and the basic roller RB2 are such that opposite end portions of each of the linear portions are located at different axial positions, the distance between the axial positions being equal to the interval between two adjacent cutting-positioning circumferential grooves. Accordingly, the linear portions of the wire extend in an inclined direction that forms a predetermined angle corresponding to the interval with respect to a direction perpendicular to the axial direction. Thus, the tension of the wire W induces an axial force (hereinafter called a "thrust force") that is associated with the interval and acts on the basic roller RB2 at the cutting-positioning circumferential grooves g1 to g9. Specifically, a thrust force F1 (a force directed to the left in FIG. 15B) corresponding to the distance I is generated at the circumferential grooves g1, g2, g4, g5, g7, and g8, whereas a thrust force F2 (a force directed to the left in FIG. 15B; F2>F1) corresponding to the distance m is generated at the circumferential grooves g3 and g6.

As mentioned previously, the thrust forces F1 and F2 accelerate, for example, wear that involves the wire W and the cutting-positioning circumferential grooves g1 to g9 (side walls of the grooves g1 to g9) of the basic roller RB2, potentially causing an impairment in accuracy in the axial position of the linear portions Y (accordingly, an impairment in accuracy in machining the worksheet WS). Therefore, the smaller such a thrust force, the more preferred.

Figure 16B:
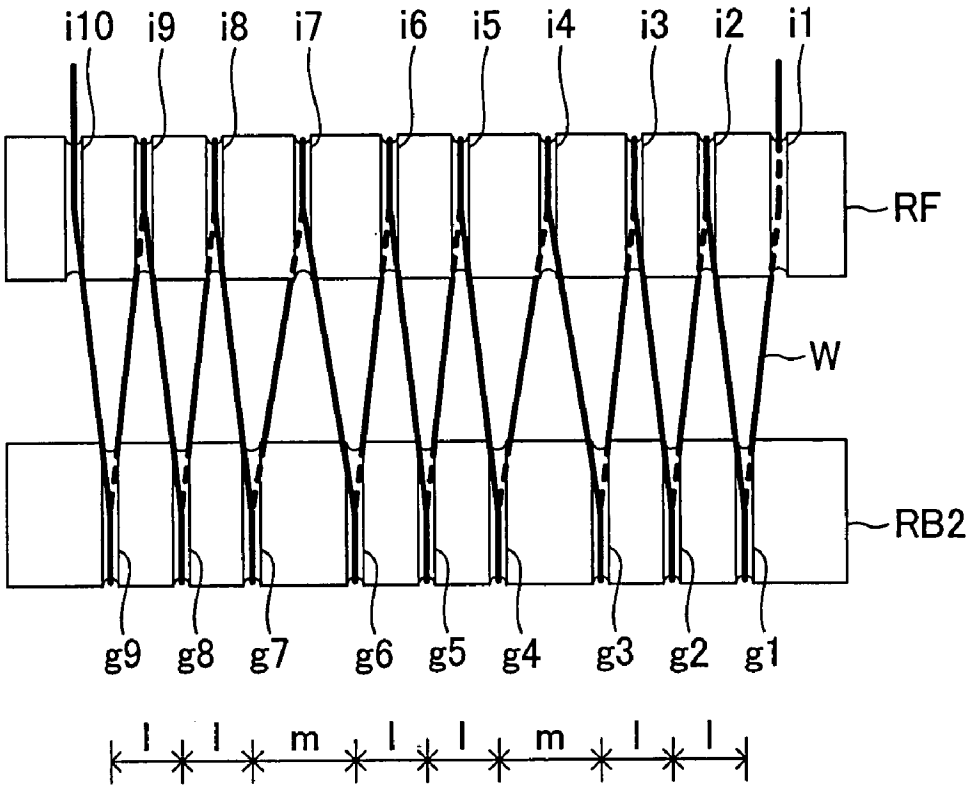
FIGS. 16A and 16B are views showing winding of a wire on three rollers of a wire sawing apparatus (wire sawing method) according to an embodiment of the present invention.
Figure 16A:
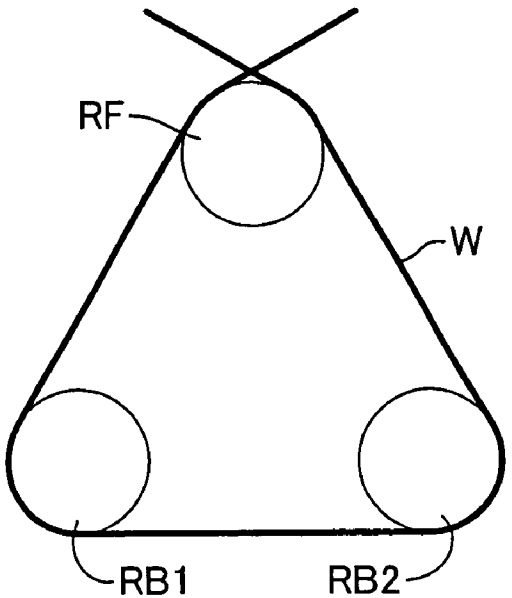

FIG. 16 shows winding of the wire W in the present embodiment. Referring to FIG. 16 (FIG. 16A is a front view, and FIG. 16B is a right side view), wire-feeding circumferential grooves (particularly called "intermediate circumferential grooves") are provided on the wire feed roller RF such that their axial positions correspond to axially central positions between every two adjacent pairs of cutting-positioning circumferential grooves among the cutting-positioning circumferential grooves g1 to g9 formed on the basic rollers RB1 and RB2. Specifically, for example, with respect to the axial direction, an intermediate circumferential groove i2 is provided at the center position between the cutting-positioning circumferential grooves g1 and g2, and an intermediate circumferential groove i3 is provided at the center position between the cutting-positioning circumferential grooves g2 and g3.

As shown in FIG. 16B, in this case, the wire W is fitted into an intermediate circumferential groove i1, next into a pair of cutting-positioning circumferential grooves g1, then into the intermediate circumferential groove i2, subsequently into a pair of cutting-positioning circumferential grooves g2, and so on. This winding operation is repeated in the axial direction (leftward in FIG. 16B), thereby spirally winding the wire W on the three rollers. The axial intervals between adjacent cutting-positioning circumferential grooves are similar to those in FIG. 15B.

In this case, a thrust force that is associated with half the interval between two adjacent cutting-positioning circumferential grooves acts on the basic rollers RB1 and RB2 at the cutting-positioning circumferential grooves. The thrust force is smaller than a thrust force associated with the interval between two adjacent cutting-positioning circumferential grooves. Specifically, in the basic roller RB1, a thrust force F3 (a force directed to the left in FIG. 16B; F3<F1) associated with a distance l/2 is generated at the circumferential grooves g1, g2, g4, g5, g7, and g8, and a thrust force F4 (a force directed to the left in FIG. 16B; F4<F2) associated with a distance m/2 is generated at the circumferential grooves g3 and g6. In the basic roller RB2, a thrust force F5 (a force directed to the right in FIG. 16B; F5=F3) associated with the distance l/2 is generated at the circumferential grooves g2, g3, g5, g6, g8, and g9, and a thrust force F6 (a force directed to the right in FIG. 16B; F6=F4) associated with the distance m/2 is generated at the circumferential grooves g4 and g7.

As compared with the case of FIG. 15B, the present embodiment of FIG. 16B can reduce the magnitude of the thrust force. As a result, the degree of wear of the cutting-positioning circumferential grooves g1 to g9 decreases. Thus, there can be realized a reduction in the degree of impairment in accuracy in machining the worksheet WS, the accuracy being impaired with the cumulative time of operation of the wire saw.

Figure 17:
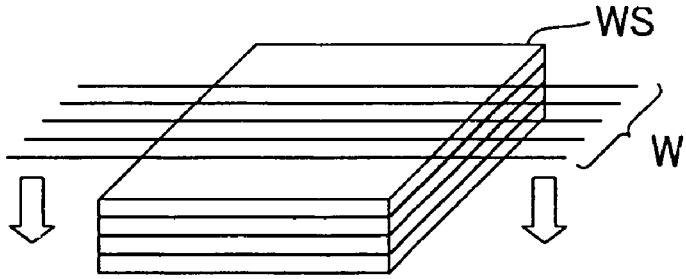
FIG. 17 is a view showing a wire sawing operation in which, while the wire is reciprocated in a plane perpendicular to the direction of lamination of ceramic green sheets used to form the worksheet, the wire is advanced (moved) in the direction of lamination.
Figure 18:
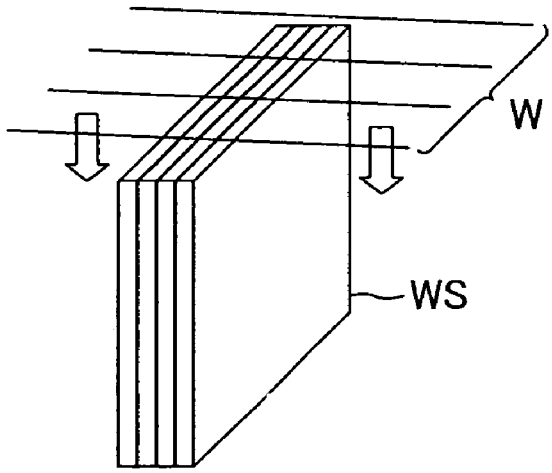
FIG. 18 is a view showing a wire sawing operation in which, while the wire is reciprocated in a plane in parallel with the direction of lamination of the ceramic green sheets, the wire is advanced (moved) in a direction perpendicular to the direction of lamination.

The above-described wire sawing operation is illustrated in FIG. 17. Specifically, while the wire W (a plurality of linear portions Y of the wire W) is reciprocated in a plane perpendicular to the direction of lamination of ceramic green sheets used to form the worksheet WS, the wire W is advanced (moved) in the direction of lamination. Alternatively, the wire sawing operation may be performed as shown in FIG. 18. Specifically, while the wire W (a plurality of linear portions Y of the wire W) is reciprocated in a plane in parallel with the direction of lamination of the ceramic green sheets, the wire W is advanced (moved) in a direction perpendicular to the direction of lamination.

Figure 19A:
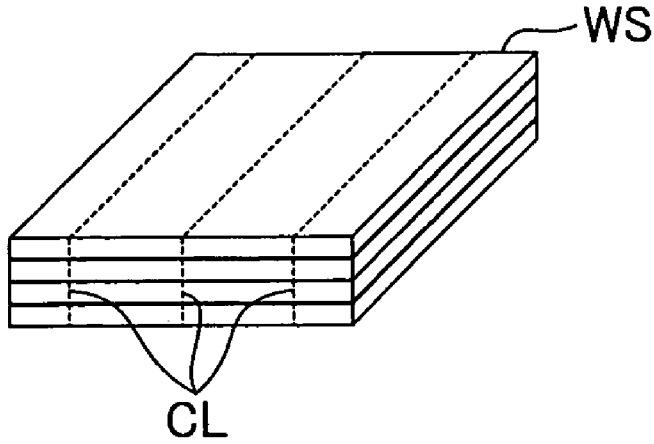
FIGS. 19A to 19C are views showing an actual procedure for performing the wire sawing operation of FIG. 18.
Figure 19B:
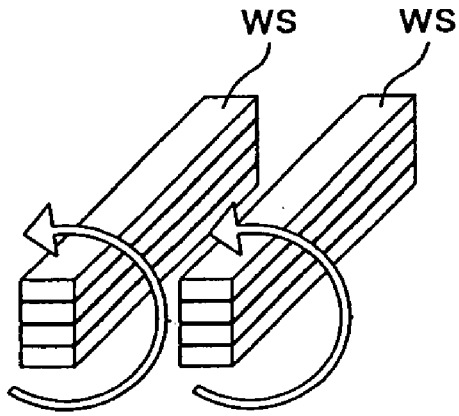

In this case, preferably, the wire sawing operation is performed as follows. First, as shown in FIG. 19A, the worksheet WS disposed on the stage is cut along cutting planes corresponding to the cutting lines CL by means of dicing or the like, thereby preparing a plurality of workpieces ws. Next, as shown in FIG. 19B, the plurality of workpieces ws are rotated on the stage by 90° in the direction of the arrow. The workpieces ws are thus rearranged on the stage as shown in FIG. 19C and are then subjected to wire sawing by means of the wire W.

Figure 19C:
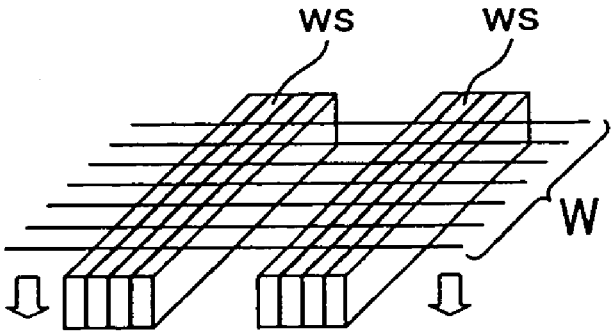
Figure 20:
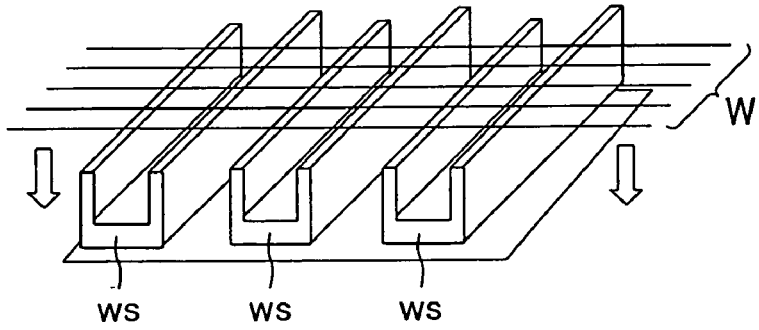
FIG. 20 is a view showing an actual arrangement of the workpieces shown in FIG. 19C.

FIG. 20 is a detailed view of the workpieces ws shown in FIG. 19C. As shown in FIG. 20, the workpieces ws are arranged on the stage in such a manner that a portion of each workpiece ws corresponding to an opening portion (a space located between the holding portions 13 (between end portions of the thin-plate portions 12) in FIG. 1) of a piezoelectric/electrostrictive device faces upward, the piezoelectric/electrostrictive device being a product to be yielded by wire sawing effected by the wire W.

Figure 21:
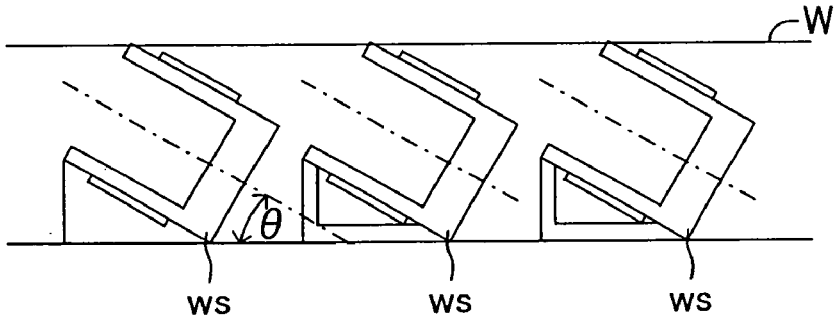
FIG. 21 is a view showing an inclined arrangement of the workpieces shown in FIG. 20.

FIG. 21 shows a state in which the workpieces ws of FIG. 20 are inclined on the stage at an angle θ with respect to the stage by use of predetermined jigs. Such an arrangement has the following advantage. The wire W first cuts into a portion of relatively high hardness of the workpiece ws, which portion is to become a thin-plate portion. Then, when the reciprocating motion of the wire W is stabilized, the wire W starts cutting a portion of relatively low hardness of the workpiece ws, which portion is to become a piezoelectric/electrostrictive element. Accordingly, a good condition of cut is imparted to the portion of the workpiece ws that is to become a piezoelectric/electrostrictive element. Also, since the length of a portion to be cut (the area of a portion to be cut, or a machining load) at the time of starting cutting becomes short, the wire W readily cuts into the workpieces ws. Thus, the reciprocating motion of the wire W is readily stabilized.

Figure 22:
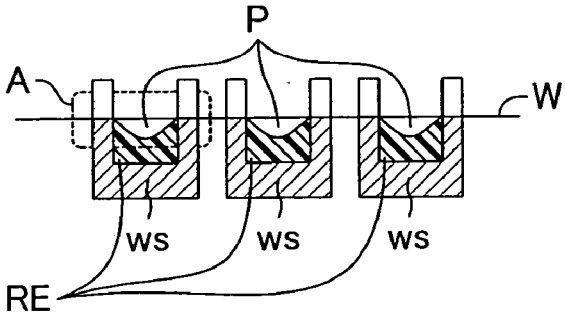
FIG. 22 is a view showing a wire sawing operation in which wire sawing is performed on workpieces whose interior spaces contain resin.
Figure 23:
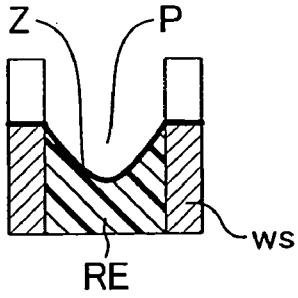
FIG. 23 is an enlarged fragmental view of FIG. 22.

Preferably, wire sawing is started in the following condition. As shown in FIG. 22, and FIG. 23, which is an enlarged view of a region A of FIG. 22, a filler RE, such as wax or resin, whose hardness is lower than that of the workpiece ws is placed in the interior space of each of the workpieces ws, which are placed on the stage in such a manner that their opening portions face upward as shown in FIG. 20.

Since the filler RE is lower in hardness than the workpiece ws, wire sawing of the filler RE proceeds at a higher rate than wire sawing of the workpiece ws. As a result, as shown in FIG. 23, in the course of cutting in the interior space of the workpiece ws, a cutting line Z at a certain point of time assumes the form of a downward convex curve, thereby forming a slurry pocket P in the interior space. In the course of wire sawing, slurry that contains abrasive grains and is fed toward the workpiece ws is trapped in the slurry pocket P. Accordingly, a sufficient amount of slurry is stably fed to a clearance between the wire W and the cut surface of the workpiece ws. Therefore, smooth cutting is performed.

Figure 24:
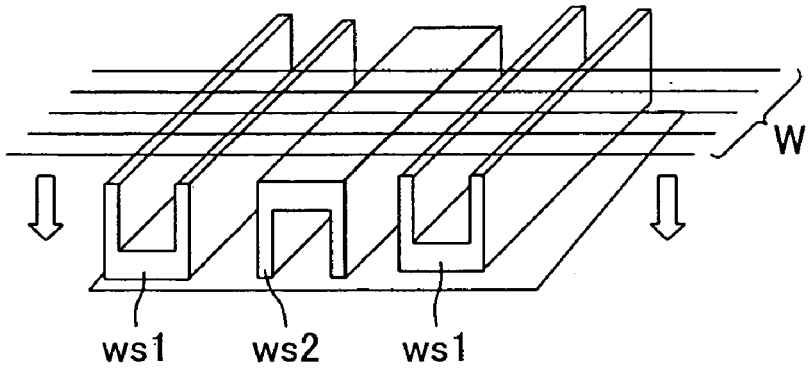
FIG. 24 is a view showing an arrangement in which, among the workpieces shown in FIG. 20, some workpieces are arranged in such a manner as to be rotated by 180° (in such a manner that an opening portion faces downward)

Preferably, as shown in FIG. 24, among a plurality of (three in FIG. 20) workpieces ws arranged as shown in FIG. 20, some workpieces ws (a single workpiece ws, or a workpiece ws 2, in FIG. 24) are arranged in such a manner as to be rotated by 180° (in such a manner that the above-mentioned opening portion faces downward). Such an arrangement reduces the degree of a change in the length of a portion to be machined (the area of a portion to be machined, or a machining load), whereby wire sawing can be stabilized.

Figure 25:
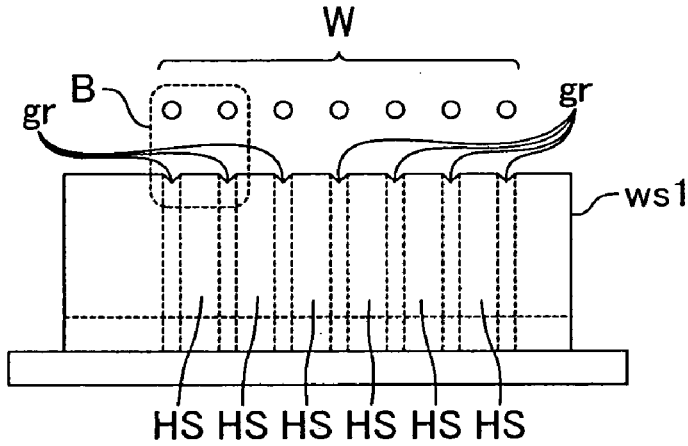
FIG. 25 is a side view of the workpiece of FIG. 24 on which guide grooves are provided for guiding the wire to positions where cutting by means of the wire W starts.
Figure 26:
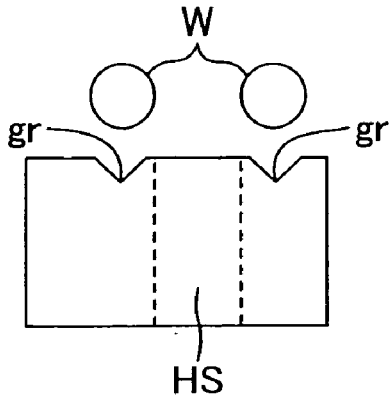
FIG. 26 is an enlarged fragmental view of FIG. 25.

Preferably, as shown in FIG. 25, and FIG. 26, which is an enlarged view of a region B of FIG. 25, guide grooves gr are provided on the two workpieces ws1 arranged on the stage as shown in FIG. 24. The grooves gr are adapted to guide linear portions of the wire W to positions where cutting by means of the wire W starts (predetermined positions at tip ends of thin-plate portions of piezoelectric/electrostrictive devices). At the time of starting cutting, the grooves gr accurately guide linear portions of the wire W to predetermined cutting positions and stabilize the reciprocating motion of the wire W. Since wire sawing starts in such a stable condition, wire sawing can be performed at high accuracy.

Preferably, guide grooves gr are provided on the workpiece ws2 shown in FIG. 24. Specifically, the guide grooves gr are adapted to guide linear portions of the wire W to positions where cutting by means of the wire W starts (predetermined positions on end surfaces of stationary portions of piezoelectric/electrostrictive devices). Employment of such guide grooves gr more stabilizes the reciprocating motion of the wire W. Preferably, the grooves gr are formed at a stage of machining ceramic green sheets.

Figure 27:
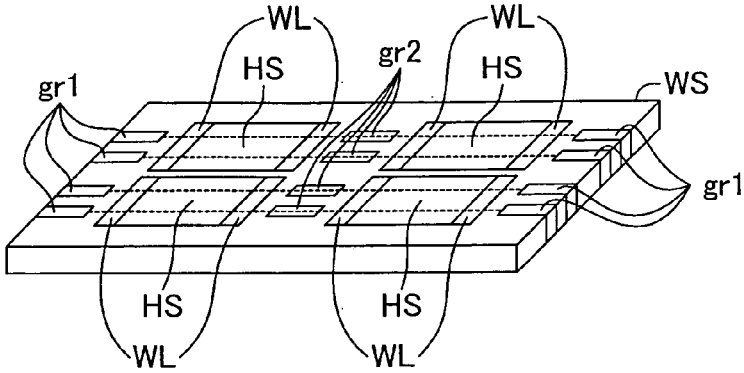
FIG. 27 is a perspective view of an object to be cut by a wire sawing method according to another embodiment of the present invention.
Figure 28:
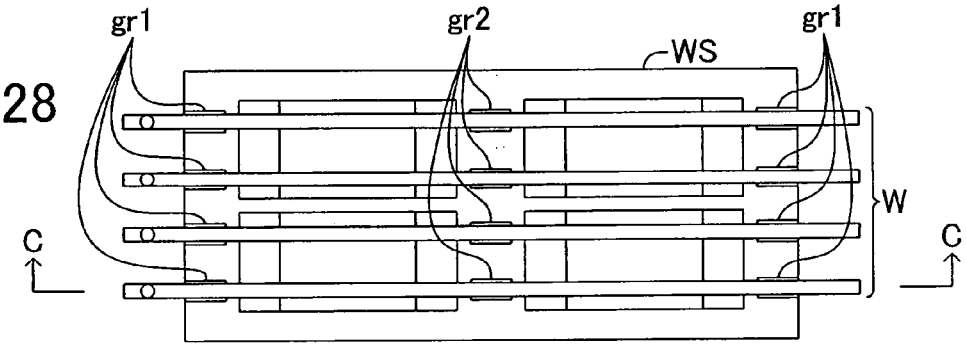
FIG. 28 is a view showing the positional relationship between the wire and the object to be cut shown in FIG. 27.
Figure 29:
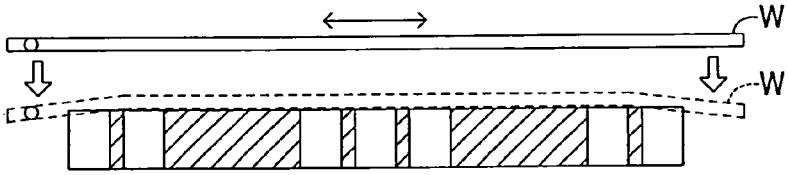
FIG. 29 is a sectional view of the object to be cut by a plane extending along line C—C of FIG. 28.

Preferably, as shown in FIGS. 27 to 29, guide grooves gr1 for guiding linear portions of the wire W to cutting positions of the worksheet WS at the time of start of cutting are provided on the worksheet WS at opposite end portions of cutting zones. As shown in FIG. 29, when cutting starts, the linear portions of the wire W are slightly bent in the cutting advancement direction (downward) at the opposite end portions of the worksheet WS while being fitted into the grooves gr1.

As a result, the linear portions of the wire W are accurately guided to the cutting positions of the worksheet WS, and the reciprocating motion of the wire W is stabilized. While this state is maintained, the worksheet WS undergoes cutting. Accordingly, wire sawing can be performed at high accuracy. In this case, as shown in FIGS. 27 to 29, if through windows gr2 are provided beforehand in the worksheet WS at central positions of the cutting zones with respect to the reciprocating direction of the wire W, the reciprocating motion of the wire W is more stabilized.

More preferably, as shown in FIGS. 27 to 29, through windows for determining the overall length of the objects HS to be cut are formed beforehand in the worksheet WS. The through windows are equivalent to the windows WL shown in FIGS. 10 and 11. Each of the through windows can function as a slurry pocket for trapping slurry fed to the worksheet WS and allowing the trapped slurry to be fed into a clearance between the wire W and a cut surface of the worksheet WS. Accordingly, a sufficient amount of slurry can be continuously fed into the clearance, thereby reliably preventing an increase in a delay in feed of slurry.

Preferably, the grooves gr1, the through windows gr2, and the windows WL are formed at a stage of machining ceramic green sheets. A clearance between the wire W and the groove gr1 (or the through window gr2) may be set to two to four times the average grain size of abrasive grains contained in slurry.

Figure 30A:
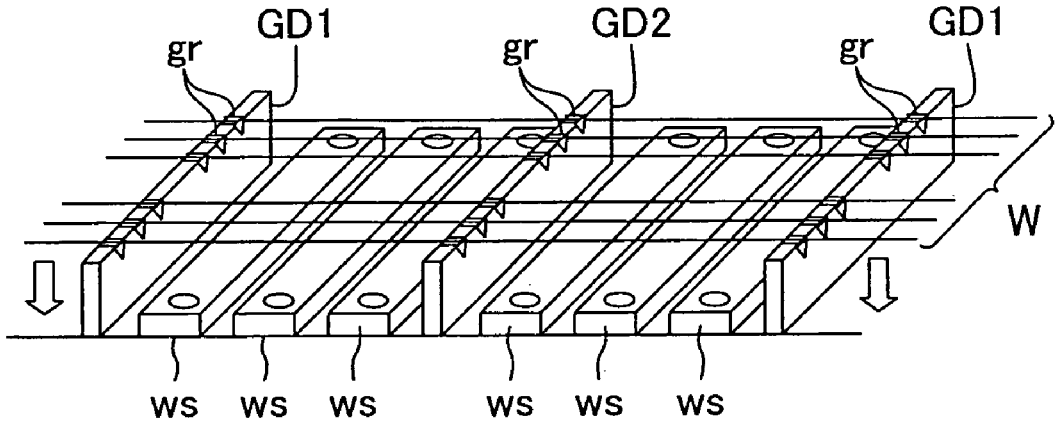
FIGS. 30A and 30B are perspective views showing a wire sawing operation in which workpieces arranged between a pair of guides are subjected to wire sawing.
Figure 30B:
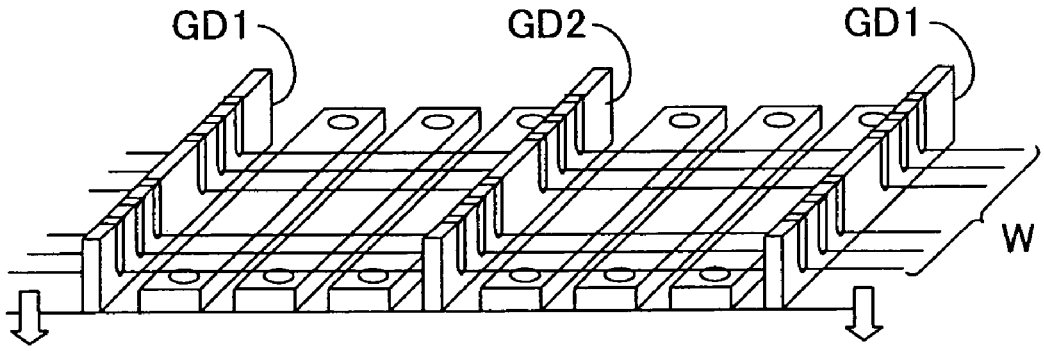

Preferably, as shown in FIG. 30, a pair of guides GD1 are disposed on the stage in such a manner that the workpieces ws are located therebetween. The paired guides GD1 are higher than the workpieces ws arranged on the stage. Grooves gr are formed on the upper surfaces of the paired guides GD1 in order to guide linear portions of the wire W to predetermined cutting positions. Before start of cutting of the workpieces ws, the linear portions of the wire W are accurately guided to the cutting positions of the worksheet WS by means of the grooves gr of the paired guides GD1 (FIG. 30A). Next, while being accurately guided at the cutting positions, the linear portions of the wire W cut into the grooves gr of the paired guides GD1 before cutting into the workpieces ws. As a result, the reciprocating motion of the linear portions of the wire W is stabilized. The linear portions of the wire W accurately reciprocate without any deviation from the cutting positions of the workpieces ws. In this state, cutting the workpieces ws starts (FIG. 30B). Accordingly, wire sawing can be performed at high accuracy.

In this case, preferably, as shown in FIG. 30, a guide GD2 is additionally placed on the stage at an intermediate position between the paired guides GD1. The guide GD2 is higher than the workpieces ws arranged on the stage. Grooves gr are formed on the upper surfaces of the guide GD2 in order to guide linear portions of the wire W to predetermined cutting positions. Employment of the guide GD2 further stabilizes the reciprocating motion of the wire W, thereby further enhancing machining accuracy.

Figure 31:
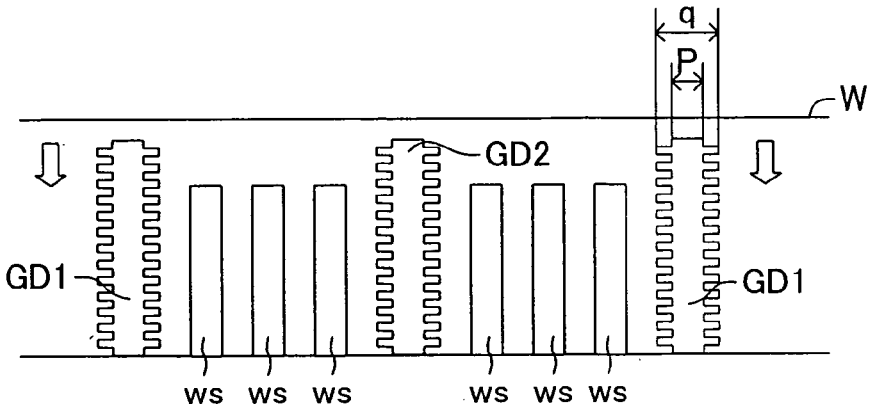
FIG. 31 is a view showing the shape of guides for use in a wire sawing method according to yet another embodiment of the present invention.

In this case, preferably, as shown in FIG. 31, the paired guides GD1 and the guide GD2 have such a shape that the length of a portion to be cut by the wire W alternates between a length p and a length q (q>p) with the position of the portion (the height of the portion above the upper surface of the stage, or the depth of penetration of the wire W into the guides). Accordingly, an area to be machined by the wire W varies periodically with the depth of penetration of the wire W into the workpieces ws (with the depth of penetration of the wire W into the guides GD1 and GD2); as a result, the machining load of the wire W varies periodically in the similar manner.

Accordingly, for example, merely by setting an appropriate, constant feed load of the wire W (a load that the wire W imposes on an object to be cut), the feed rate of the wire W can be varied periodically without use of a complicated hydraulic servomechanism or the like. Thus, as mentioned previously, an increase in a delay in feed of slurry into a clearance between the wire W and a cut surface can be reliably prevented by means of a simple configuration. Notably, either the paired guides GD1 or the guide GD2 only may have such a shape that the length of a portion to be cut alternates between the length p and the length q (q>p) with the depth of penetration of the wire W into the guide.

Figure 32:
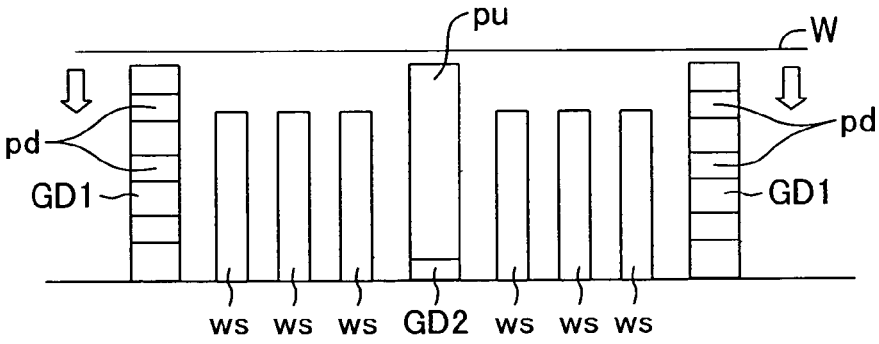
FIG. 32 is a view showing a variant shape of the guides of FIG. 31.

As shown in FIG. 32, through holes pd may be provided in the paired guides GD1 as follows: the through holes pd are located on planes of cutting by the wire W at predetermined heights above the upper surface of the stage (at predetermined depths of penetration of the wire W). This also brings about the following same effect as in the case of the embodiment shown in FIG. 31: an area to be machined by the wire W varies periodically with the depth of penetration of the wire W into the workpieces ws (with the depth of penetration of the wire W into the guides GD1 and GD2). In this case, preferably, U-shaped grooves pu which open upward and are adapted to guide the wire W are formed in the guide GD2.

Figure 33:
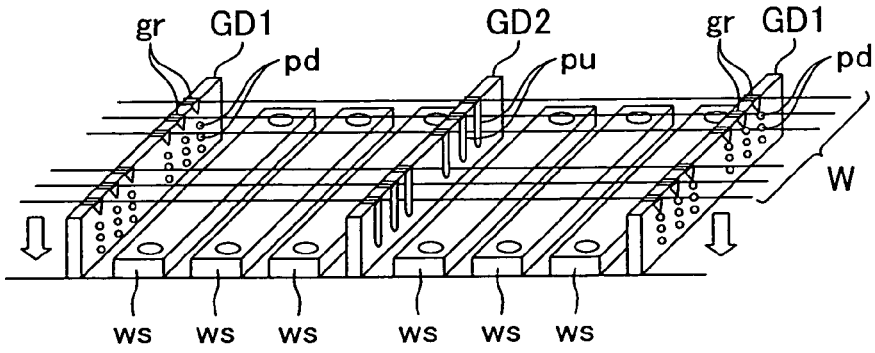
FIG. 33 is a view showing another variant shape of the guides of FIG. 31.
Figure 34A:
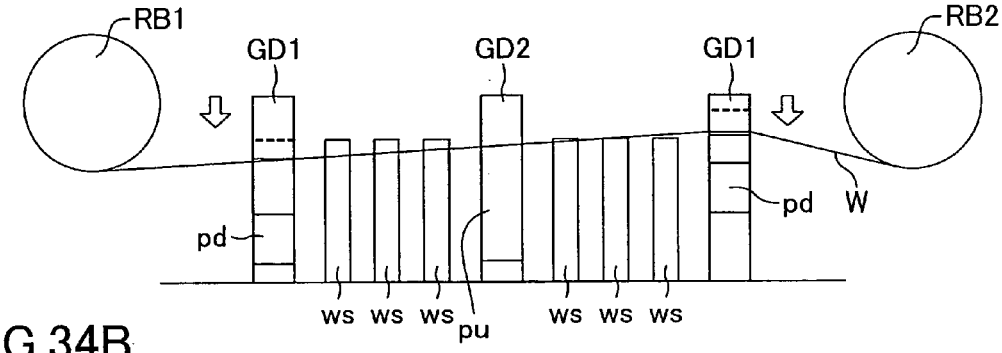
FIGS. 34A to 34D are views showing, in a time series manner, a progress of wire sawing by use of the guides shown in FIG. 33.
Figure 34B:
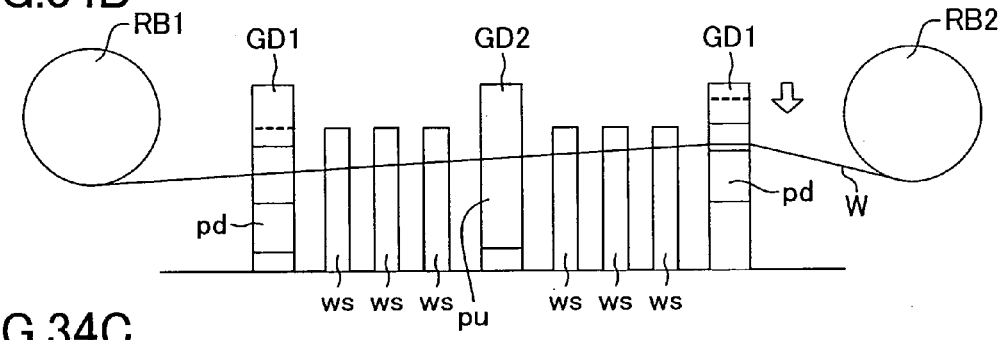
Figure 34C:
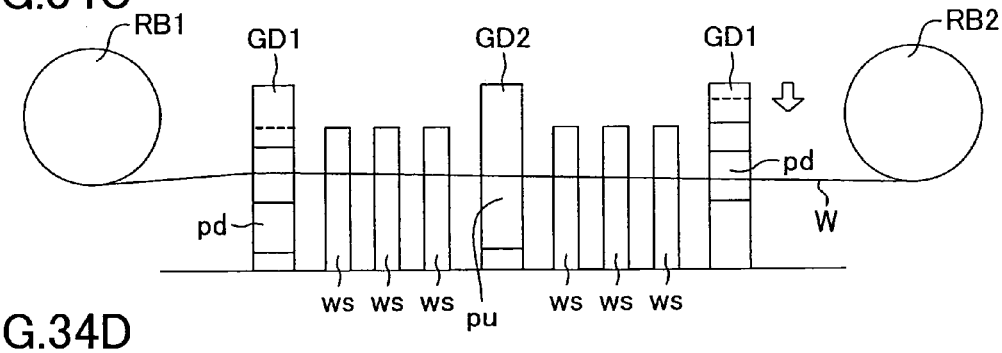
Figure 34D:
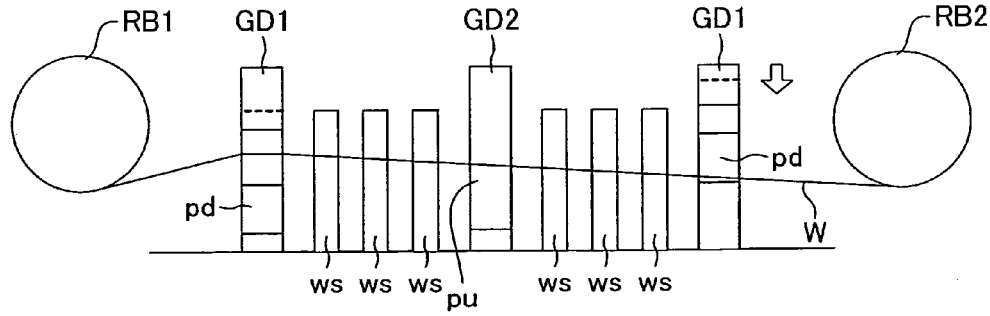
Figure 38:
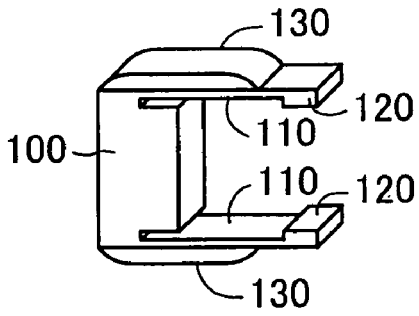
FIG. 38 is a perspective view of a conventional piezoelectric/electrostrictive device.
Figure 39:
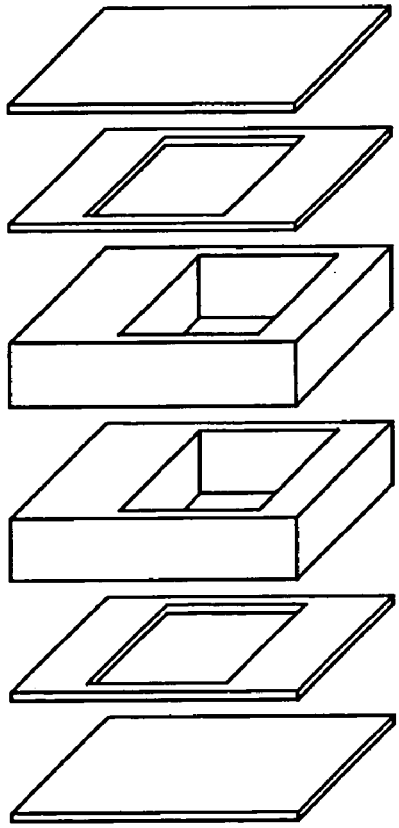
FIG. 39 is a perspective view of ceramic green sheets to be laminated for manufacturing the piezoelectric/electrostrictive device shown in FIG. 38.
Figure 40:
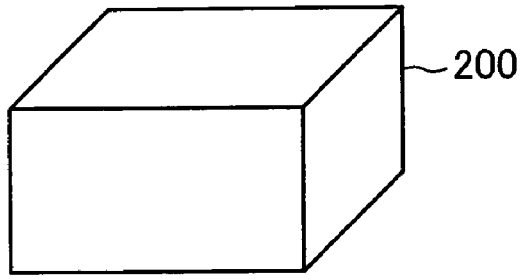
FIG. 40 is a perspective view of a ceramic laminate formed by laminating and compression-bonding the ceramic green sheets of FIG. 39 and then monolithically firing the resultant ceramic green sheet laminate.
Figure 41:
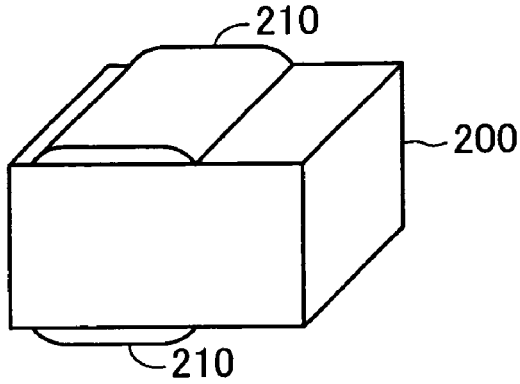
FIG. 41 is a perspective view of the ceramic laminate of FIG. 40 on which piezoelectric/electrostrictive laminates are formed.
Figure 42:
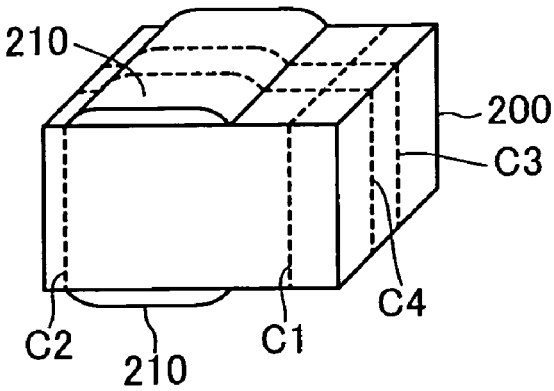
FIG. 42 is a view showing a cutting step for cutting the ceramic laminate and the piezoelectric/electrostrictive laminates shown in FIG. 41.

In the embodiment shown in FIG. 32, the through holes pd formed in the paired guides GD1 may be located at different heights as shown in FIG. 33. An example progress of wire sawing in this case is shown in a time series manner in FIGS. 34A to 34D. As shown in FIGS. 34A to 34D, since the feed rate of the wire W differs between the two guides GD1, the wire W cuts into the workpieces ws at a certain angle with respect to the horizontal direction. Accordingly, slurry is more reliably fed into a clearance between the wire W and a cut surface, thereby achieving smoother cutting.

As shown in FIG. 35, a slurry feeder for feeding slurry to the workpieces ws generally includes a slurry-stirring tank 31 for stirring slurry, a discharge pipe 32 through which slurry discharged from the slurry-stirring tank 31 flows, and a slurry reservoir 33 for temporarily storing slurry discharged from the discharge pipe 32 and feeding slurry to the workpieces ws.

Preferably, in the slurry feeder, an ultrasonic generator is disposed on at least one of the slurry-stirring tank 31, the discharge pipe 32, and the slurry reservoir 33 in order to ultrasonically impart high-frequency vibration to slurry that is fed to the workpieces ws from the slurry reservoir 33. This causes aggregates of abrasive grains unavoidably generated in slurry to be forcibly dispersed into uniform abrasive grains, thereby effectively preventing chipping of the workpieces ws or a like problem, which could otherwise result from coarse abrasive grains hitting the workpieces ws.

In the case where the workpieces ws are disposed on the machining stage in such a manner that their opening portions face upward, the ultrasonic generator is disposed preferably on the machining stage so as to ultrasonically impart high-frequency vibration to the machining stage. In this case, preferably, the ultrasonically vibrating direction of the machining stage is caused to coincide with the reciprocating direction of the wire W, and, as shown in FIG. 36, the amplitude of vibration (half the vibration distance) is a value obtained by dividing a width r of the opening portion of the workpiece ws (the distance between two holding portions) by a natural number. FIG. 36A shows a case where the amplitude is half the width r, and FIG. 36B shows a case where the amplitude is one-fourth the width r.

The above feature facilitates entry of slurry into the interior space of the workpiece ws, and the interior space functions as the above-mentioned slurry pocket. Thus, smoother wire sawing can be performed. As shown in FIG. 37, since the vibrating direction of the machining stage coincides with the reciprocating direction of the wire W, abrasive grains TR contained in slurry readily rotate in the illustrated direction in a clearance between the wire W and the cut surface of the workpiece ws, so that feed of slurry into the clearance is facilitated.

Obviously, numerous modifications and variations of the present invention are possible in light of the above teachings. It is therefore to be understood that within the scope of the appended claims, the present invention may be practiced otherwise than as specifically described herein.

The invention claimed is:

1. A wire sawing apparatus comprising:

two basic rollers disposed with their axes of rotation in parallel with each other, a plurality of cutting-positioning circumferential grooves being provided on a cylindrical surface of each of the two basic rollers and arranged in an axial direction, the cutting-positioning circumferential grooves of one basic roller and the corresponding cutting-positioning circumferential grooves of the other basic roller being paired and located at the same axial positions;

a wire feed roller disposed with its axis of rotation not located on a plane including the axes of rotation of the two basic rollers and with its axis of rotation in parallel with the axes of rotation of the two basic rollers, a plurality of intermediate circumferential grooves being provided on a cylindrical surface of the wire feed roller and arranged in the axial direction, axial positions of the intermediate circumferential grooves each corresponding to a substantially axially central position between two adjacent pairs of cutting-positioning circumferential grooves; and a wire spirally wound a plurality of turns around the two basic rollers and the wire feed roller from a first end to a second end with respect to the axial direction by repeating a unit winding operation of winding the wire in such a manner that the wire is fitted into one pair of two adjacent pairs of cutting-positioning circumferential grooves, the one pair being located on a side toward the first end, is fitted into an intermediate circumferential groove corresponding to the adjacent pairs of cutting-positioning circumferential grooves, and is then fitted into the other pair of cutting-positioning circumferential grooves located on a side toward the second end;

wherein a plurality of linear portions of the wire extending between the two basic rollers are arranged at axial positions corresponding to the pairs of cutting-positioning circumferential grooves and are caused to reciprocate in their own linear directions along with a rotary movement of the three rollers to cut into an object to be cut, thereby cutting the object simultaneously at a plurality of positions.

2. A wire sawing method for cutting an object to be cut by use of the wire sawing apparatus according to claim 1, comprising the steps of:

disposing the object to be cut on a stage;

reciprocating a plurality of linear portions of a wire in their own linear directions; and varying a relative position between the stage and the linear portions of the wire with respect to a cutting advancement direction so as to cause the plurality of linear portions of the wire to cut into the object to be cut, thereby cutting the object.

3. A wire sawing method according to claim 2, wherein the object to be cut comprises a plurality of integrally formed piezoelectric/electrostrictive devices which are separated from one another as a result of wire sawing and each of which comprises;

a thin-plate portion;

a stationary portion supporting the thin-plate portion; and a piezoelectric/electrostrictive element formed at least on a plane of the thin-plate portion, the piezoelectric/electrostrictive element including a plurality of electrodes and a plurality of piezoelectric/electrostrictive layers arranged alternatingly in layers, and having an exteriorly exposed lateral end surface including lateral end surfaces of the plurality of electrodes and lateral end surfaces of the plurality of piezoelectric/electrostrictive layers, and at least the exteriorly exposed lateral end surface of the piezoelectric/electrostrictive element being formed by wire sawing.

4. A wire sawing apparatus according to claim 1, wherein the object to be cut comprises a plurality of integrally formed piezoelectric/electrostrictive devices which are separated from one another as a result of wire sawing and each of which comprises:

a thin-plate portion;

a stationary portion supporting the thin-plate portion; and a piezoelectric/electrostrictive element formed at least on a plane of the thin-plate portion, the piezoelectric/electrostrictive element including a plurality of electrodes and a plurality of piezoelectric/electrostrictive layers arranged alternatingly in layers, and having an exteriorly exposed lateral end surface including lateral end surfaces of the plurality of electrodes and lateral end surfaces of the plurality of piezoelectric/electrostrictive layers, and at least the exteriorly exposed lateral end surface of the piezoelectric/electrostrictive element being formed by wire sawing.

5. A wire sawing method comprising the steps of:

disposing an object to be cut on a stage;

reciprocating a linear wire in its own linear direction while feeding slurry containing abrasive grains to the object to be cut; and varying a relative position between the stage and the wire with respect to a cutting advancement direction so as to cause the wire to cut into the object to be cut, thereby cutting the object;

wherein at least a pair of guides, each having a guide portion for guiding the wire to a cutting position, are disposed on the stage in such a manner that the object to be cut is located therebetween, and the wire guided by the guide portions cuts into the guides and then the object to be cut, thereby cutting the guides and the object together; and the paired guides assume such a shape that a length of their portion to be cut as measured in the linear direction of the wire varies in a predetermined pattern with a depth of penetration of the wire into the guides.

6. A wire sawing method according to claim 5, wherein the object to be cut comprises a plurality of integrally formed piezoelectric/electrostrictive devices which are separated from one another as a result of wire sawing and each of which comprises:

a thin-plate portion;

a stationary portion supporting the thin-plate portion; and a piezoelectric/electrostrictive element formed at least on a plane of the thin-plate portion, the piezoelectric/electrostrictive element including a plurality of electrodes and a plurality of piezoelectric/electrostrictive layers arranged alternatingly in layers, and having an exteriorly exposed lateral end surface including lateral end surfaces of the plurality of electrodes and lateral end surfaces of the plurality of piezoelectric/electrostrictive layers, and at least the exteriorly exposed lateral end surface of the piezoelectric/electrostrictive element being formed by wire sawing.

7. A wire sawing method comprising the steps of:

disposing an object to be cut on a stage;

reciprocating a linear wire in its own linear direction while feeding slurry containing abrasive grains to the object to be cut; and varying a relative position between the stage and the wire with respect to a cutting advancement direction so as to cause the wire to cut into the object to be cut, thereby cutting the object;

wherein guide portions for guiding the wire to a cutting position at a time of start of cutting are provided on the object to be cut in the vicinity of opposite end portions of a cutting zone with respect to the linear direction of the wire, and a slurry pocket for trapping the fed slurry is provided on the object to be cut so as to allow the trapped slurry to be fed into a clearance between the wire and a cut surface of the object to be cut.

8. A wire sawing method according to claim 7, wherein the object to be cut comprises a plurality of integrally formed piezoelectric/electrostrictive devices which are separated from one another as a result of wire sawing and each of which comprises:

a thin-plate portion;

a stationary portion supporting the thin-plate portion; and a piezoelectric/electrostrictive element formed at least on a plane of the thin-plate portion, the piezoelectric/electrostrictive element including a plurality of electrodes and a plurality of piezoelectric/electrostrictive layers arranged alternatingly in layers, and having an exteriorly exposed lateral end surface including lateral end surfaces of the plurality of electrodes and lateral end surfaces of the plurality of piezoelectric/electrostrictive layers, and at least the exteriorly exposed lateral end surface of the piezoelectric/electrostrictive element being formed by wire sawing.

* * * * *